United States Patent [19]

Okumura et al.

[11] 4,292,873

[45] Oct. 6, 1981

[54] ELECTRONIC MUSICAL INSTRUMENT

[75] Inventors: Takatoshi Okumura; Seiya Hamada; Akio Imamura, all of Hamamatsu, Japan

[73] Assignee: Nippon Gakki Seizo Kabushiki Kaisha, Hamamatsu, Japan

[21] Appl. No.: 101,904

[22] Filed: Dec. 10, 1979

[30] Foreign Application Priority Data

Dec. 12, 1978 [JP] Japan ..... 53/154411

[51] Int. Cl.[3] ..... G10H 1/057; G10H 5/00

[52] U.S. Cl. ..... 84/1.01; 84/1.13; 84/1.26

[58] Field of Search ..... 84/1.01, 1.03, 1.11, 84/1.13, 1.17, 1.19, 1.24, 1.26, DIG. 2, DIG. 10, DIG. 23; 340/365 E

[56] References Cited

U.S. PATENT DOCUMENTS 4,014,238 3/1977 Southard ..... 84/1.13

4,182,210 1/1980 Nishimoto ..... 84/1.01

*Primary Examiner*—S. J. Witkowski

*Attorney, Agent, or Firm*—Spensley, Horn, Jubas & Lubitz

[57] ABSTRACT

An electronic musical instrument comprises a key on-off memory for storing the on-off state of the respective keys, and at a time counter for counting the lapse of time after release of the respective keys. The time counter inhibits generation of the musical tone signal corresponding to the key when the conditions that predetermined time is elapsed after the key release and that the key-off state is stored in the memory are satisfied. This inhibition is separately conducted with respect to the keys. Thus, it can remarkably prevent noise when the tone should not be produced.

9 Claims, 13 Drawing Figures

| TIME SLOT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 |
|---|---|---|---|---|---|---|---|---|---|---|---|---|---|---|---|---|---|---|---|---|---|---|---|---|---|---|---|
| KC1 | "1" | | | | $B_1$ | $N_1$ | | $B_1$ | $N_1$ | | | | | | | | | | | | | | | | | | |
| KC2 | "1" | | | | $B_2$ | $N_2$ | | $B_2$ | $N_2$ | | " | " | | " | " | | " | " | | " | " | | " | " | | " | " |
| KC3 | "1" | | | T | $B_3$ | $N_3$ | | $B_3$ | $N_3$ | | | | | | | | | | | | | | | | | | |
| KC4 | "1" | | | | $KO_1$ | $N_4$ | | $KO_1$ | $N_4$ | | | | | | | | | | | | | | | | | | |
| KEYBOARD | | | | | U | U | | U | U | | U | U | | U | U | | U | U | | U | U | | U | U | | L | L |
| CHANNEL | | | | | ch1 | ch1 | | ch2 | ch2 | | ch3 | ch3 | | ch4 | ch4 | | ch5 | ch5 | | ch6 | ch6 | | ch7 | ch7 | | ch1 | ch1 |

| TIME SLOT | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 |
|---|---|---|---|---|---|---|---|---|---|---|---|---|---|---|---|---|---|---|---|---|---|---|---|---|---|---|---|
| KC1 | | $B_1$ | $N_1$ | | $B_1$ | $N_1$ | | | | | | | | | | | | | | | | | | | | | |
| KC2 | | $B_2$ | $N_2$ | | $B_2$ | $N_2$ | | " | " | | " | " | | " | " | | " | " | | | | | | | | | |
| KC3 | | $B_3$ | $N_3$ | | $B_3$ | $N_3$ | | | | | | | | | | | | | | | | | | | | | |
| KC4 | | $KO_1$ | $N_4$ | | $KO_1$ | $N_4$ | | | | | | | | | | | | | | | | | | | | | |
| KEYBOARD | | L | L | | L | L | | L | L | | L | L | | L | L | | L | L | | | | | | | | | |
| CHANNEL | | ch2 | ch2 | | ch3 | ch3 | | ch4 | ch4 | | ch5 | ch5 | | ch6 | ch6 | | ch7 | ch7 | | | | | | | | | |

FIG.2

TIME
t1
t2
t3
t4
t5
t6
t7
t8
t9
Φ11
Φ12
NORMAL
C1
P
Q1
Q2
Q3
Q4
Q5
Q6
Q7
Q8
Q9
M1
M2

ELECTRONIC MUSICAL INSTRUMENT

TITLE OF THE INVENTION

Electronic musical instrument

BACKGROUND AND SUMMARY OF THE INVENTION

This invention relates to an electronic musical instrument and, more particularly, to prevention of noise in an electronic musical instrument.

There has been known an electronic musical instrument which has tone production channels smaller in number than a total number of keys provided in the keyboard, generates, channel by channel vibratory musical tone signals for keys which have been assigned to the respective channels and controls amplitude envelopes the tone signals with respect to each of the channels in accordance with depression (key-on) and release (key-off) of the keys thereby to produce tones corresponding to the depressed keys.

In this type of electronic musical instrument, tone signals tend to remain existing in a stage prior to an envelope imparting circuit even after completion of the decay of the amplitude envelope after the key-off, and this causes undesirable occurrence of idling noise leakage noise.

It is, therefore, an object of the invention to effectively prevent occurrence of such noise in an electronic musical instrument.

It is another object of the invention to provide an electronic musical instrument capable of preventing noise by inhibiting, channel by channel, generation of a tone signal of the channel upon lapse of a predetermined time after the key is released. For achieving this object, key-off of the key assigned to each channel is detected with respect to each channel, a counting circuit is operated in accordance with the detection of key-off and, when the count of the counting circuit has reached a certain value, generation of the tone signal thereafter is inhibited. As the counting circuit for the abovementioned inhibition a counting circuit for controlling an amplitude envelope of the musical tone is used commonly whereby the circuit design is simplified.

These and other objects and features of the invention will become apparent from the description made hereinbelow with reference to the accompanying drawings.

BRIEF DESCRIPTION OF THE DRAWINGS

FIG. 2 is a diagram showing contents for each time slot of time division multiplexed data $KC_1$–$KC_4$ provided by key code mutiplexing circuit shown in FIG. 1;

DESCRIPTION OF PREFERRED EMBODIMENTS

Figure 1:
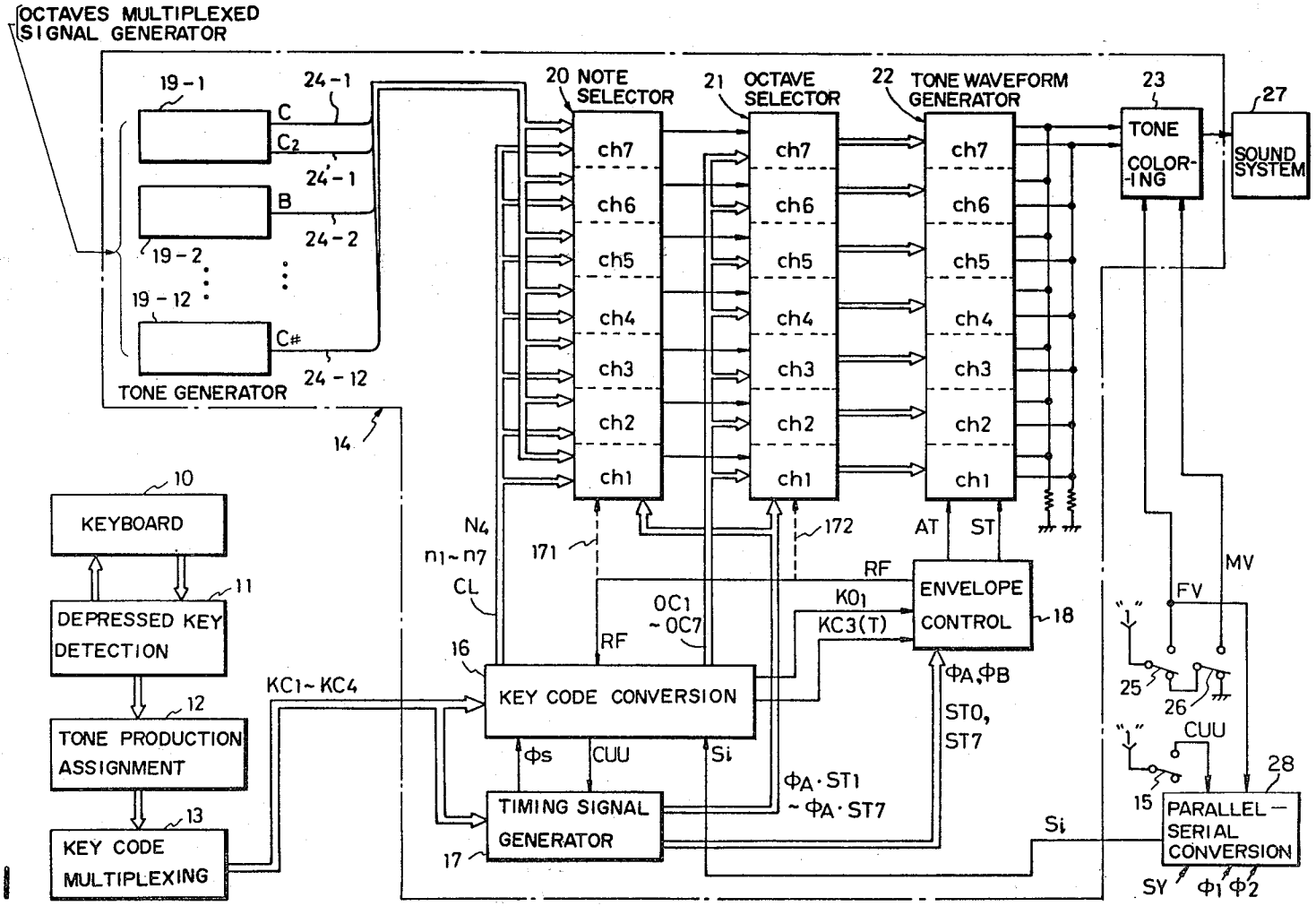
FIG. 1 is a block diagram showing an entire structure of an embodiment of the electronic musical instrument according to the invention.

Referring to FIG. 1, a keyboard 10 has an upper keyboard and a lower keyboard. A depressed key detection circuit 11 detects states of key depression in the keyboard 10 and supplies data representing depressed keys to a tone production assignment circuit 12. This tone production assignment circuit 12 is a circuit for assigning generation of tones of the depressed keys to available ones of specific number of channels. The circuit 12 generates, on a time shared basis, key codes representing the assigned keys, each code consisting of a note code of four bits N4, N3, N2, N1 and an octave code of three bits B3, B2, B1 and also generates a key-on signal KO1 representing an on-off state of the assigned key with respect to each channel. The key-on signal KO1 is a signal which is "1" while the key is being depressed and is "0" when the key is released. Once a key has been assigned to a certain channel, the key code (N1–N4, B1–B3) thereof does not disappear from the channel even after release of the key and the content of the key code changes only when a new key has been assigned to the channel. The number of the tone production channels in the present embodiment is seven for the upper keyboard and seven for the lower keyboard and the depressed keys are assigned to the channels for the respective keyboards to which the keys belong.

The key code N1–N4, B1–B3 and the key-on signal KO1 outputted from the tone production assignment circuit 12 are supplied to a key code multiplexing circuit 13. The key code multiplexing circuit 13 multiplexes the key code N1–N4, B1–B3 and the key-on signal KO1 of each channel into data KC1–KC4 which is of a smaller number of bits than the total bit number of the key code N1–N4, B1–B3 plus the key-on signal KO1 and delivers out this multiplexed data KC1–KC4. Before delivering out of the multiplexed data, the key code multiplexing circuit 13 delivers out reference data employed for discriminating (identifying) time slots at which the key codes of respective channels are allotted. The reference data consists of data in which the bits $KC_1$, $KC_2$, $KC_3$ and $KC_4$ are all "1".

There are fifty-four time slots for the multiplexed 4-bit data KC1–KC4, and FIG. 2 shows the states of respective data bits K1–K4 at respective time slots Nos. 1–54. The time slot at which the reference data "1111" is generated is designated as the time slot No. 1. The width of one time slot is determined by master clock pulses $\phi_1$ and $\phi_2$ which constitute a two-phase clock pulse with a period of 1 microsecond. The letter "U" shown in the row of "keyboard" denotes channels to which tones of the upper keyboard are exclusively assigned and the letter "L" denotes channels to which tones of the lower keyboard are exclusively assigned. Reference characters ch1–ch7 shown in the row of "channel" denote channels to which the respective key codes are assigned. As will be apparent from FIG. 2, there time slots are allotted for each one channel. In each channel, the data KC1–KC4 are "0" at the first time slot. At the second time slot, the octave code B1–B3 is delivered out as the data KC1–KC3 and the key-on signal KO1 as the data KC4. At the third time slot, the note code bits N1–N4 are delivered out as the data KC1–KC4. The data KC3 is used for producing a timing pulses T of a predetermined period at a time slot "4". This timing pulse T is generated in the tone production assignment circuit 12, supplied to the tone generator 14 through the key code multiplexing circuit 13 and used therein. The circuit construction wherein the key code multiplexing circuit 13 is provided between the tone production assignment circuit 12 and the tone generator 14 is described in detail in the specification of U.S. patent application No. 929,007 now U.S. Pat. No. 4,192,211 assigned to the same assignee as the present case. This arrangement, however, is not a subject matter of the present invention so that detailed description thereof is omitted.

Relation between the note code N1–N4 and respective notes (C#, D, . . . B,C) and relation between the octave code B1–B3 and the octave range are shown in the following Table 1.

TABLE 1

| | Note code | | | | | Octave Code | | |
|---|---|---|---|---|---|---|---|---|
| note name | N4 | N3 | N2 | N1 | Octave range | B3 | B2 | B1 |
| C# | 0 | 0 | 0 | 1 | C2 | 0 | 0 | 0 |
| D | 0 | 0 | 1 | 0 | C#2–C3 | 0 | 0 | 1 |
| D# | 0 | 0 | 1 | 1 | C#3–C4 | 0 | 1 | 0 |
| E | 0 | 1 | 0 | 1 | C#4–C5 | 0 | 1 | 1 |
| F | 0 | 1 | 1 | 0 | C#5–C6 | 1 | 0 | 0 |
| F# | 0 | 1 | 1 | 1 | C#6–C7 | 1 | 0 | 1 |
| G | 1 | 0 | 0 | 1 | | | | |
| G# | 1 | 0 | 1 | 0 | | | | |
| A | 1 | 0 | 1 | 1 | | | | |
| A# | 1 | 1 | 0 | 1 | | | | |
| B | 1 | 1 | 1 | 0 | | | | |
| C | 1 | 1 | 0 | 0 | | | | |

The data KC1–KC4 provided by the key code multiplexing circuit 13 is supplied to the tone generator 14. This tone generator 14 has seven tone production channels ch1–ch7 and is used for generating tones of keys played in either the upper keyboard or the lower keyboard as selected by operating a keyboard selection switch 15. Two or more tone generators may be provided for supplying the output data KC1–KC4 of the key code multiplexing circuit 13 thereto and generating both the upper keyboard tones and lower keyboard tones in a different tone color from the tones generated by the tone generator 14, through such arrangement is not shown in FIG. 1. A reason for retaining the key code N1–N4, B1–B3 in the channel without cancelling it even after release of the key until assignment of a new key is that in case a plurality of tone generators are provided as described above, an envelope decay time (release time) after release of the key differs one tone generator from another even for the same key and, accordingly, such irregularity in the envelope decay time does not cause any serious problem.

The key code N1–N4, B1–B3 which continues to be supplied to the tone generator 14 in the form of the data KC1–KC4 causes generation of noise out of the tone generator 14. According to the present invention, an arrangement is made for inhibiting generation of the tone signal responsive to the key code N1–N4, B1–B3 assigned to a channel for the released key in the tone generator 14 upon lapse of a certain period of time after release of the key.

The tone generator 14 comprises a key code converter 16, a timing signal generator 17, an envelope control circuit 18, octaves multiplexed signal generators 19-1 through 19-12, a note selector 20, an octave selector 21, a tone waveform generator 22 and a tone coloring circuit 23. The key code converter 16 takes the note codes N1–N4, the octave codes B1–B3, the key-on signals KO1 and the timing pulse T separately out of the data KC1–KC4 supplied in a time shared fashion from the key code multiplexing circuit 13 and generates note signals n1–n7 in response to the note codes N1–N4 and octave signals OC1–OC7 in response to the octave codes B1–B3. The timing signal generator 17 detects the time slot "1" as the data KC1–KC4 exhibit the reference data "1111" and, in accordance with this detection generates channel timing pulses ST1–ST7 ($\phi$A·ST1–$\phi$A·ST7) which are used for distributing the note signals n1–n7 and the octave signals OC1–OC7 for the respective channels to the respective assigned channels ch1–ch7 and also generates clock pulses $\phi$A, $\phi$B and $\phi$S.

The octaves multiplexed signal generator 19-1 through 19-12 are provided in correspondence to the respective notes (C#–C) and generate in a time division multiplexed fashion, i.e. as serial signals a plurality of wave data obtained by frequency-dividing a signal of a corresponding frequency of the notes (C#–C). The wave data generated in series have a relation of $2^n$ in respect of their frequencies (i.e. an octave relation). Accordingly, the output of one of the octaves multiplexed signal generators 19-1 through 19-12 is observed as binary data of a plurality of bits aligned time-wise serially. Such a signal generator is disclosed in detail in the specification of U.S. patent application No. 915,239 now U.S. Pat. No. 4,228,403 assigned to the same assignee as the present case, and entitled "Submultiple-related-frequency wave generator".

Figure 3:
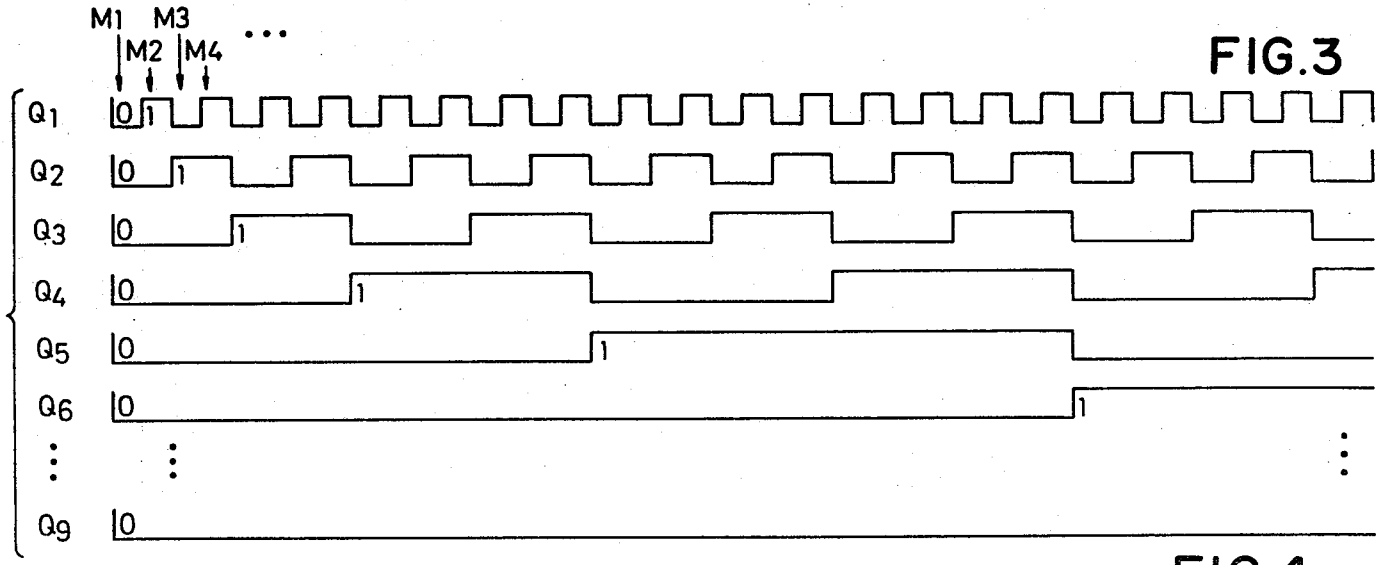
FIG. 3 is a time chart showing states of data $Q_1$–$Q_9$ used to provide octaves multiplexed signals in the tone generator shown in FIG. 1.
Figure 4:
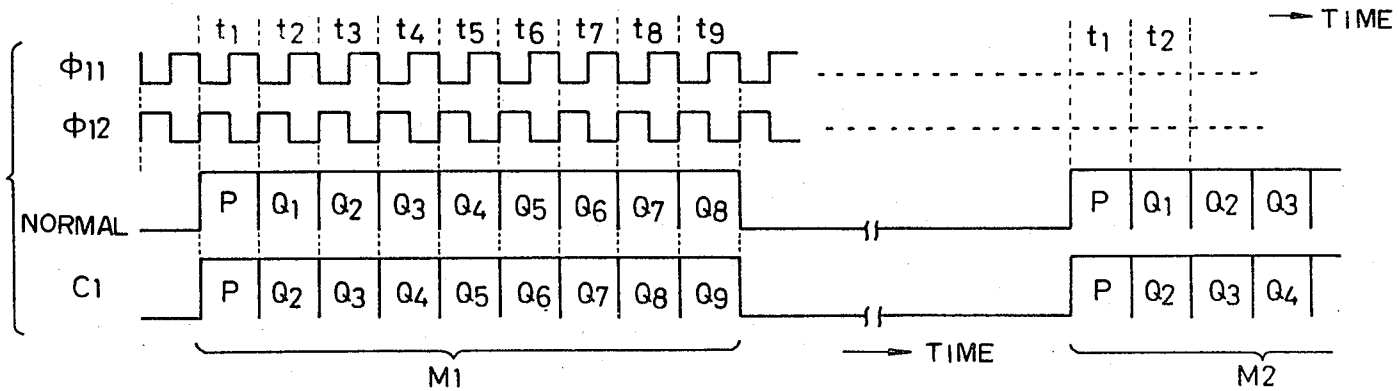
FIG. 4 is a time chart showing states of octaves multiplexed signals generated by the octaves multiplexed signal generators shown in FIG. 1.

Each of the octave multiplexed signal generators 19-1 through 19-12 generates, successively and in series, data representing an amplitude level ("1" or "0") of each of octavely related data Q1–Q9 which are in an octave relation, i.e. having frequencies obtained by successively dividing the highest frequency of the note corresponding to the generator, every time the amplitude level of at least the data Q1 of the highest fequency is inverted. FIG. 3 shows the octavely related data Q1–Q9 generated in one of the octaves multiplexed signal generators, e.g. 19-1, corresponding to a certain note, e.g. C. If weight of the signal Q1 is $2^0=1$, weight of Q2, Q3 . . . Q8, Q9 are respectively $2^1$, $2^2$ . . . $2^7$, $2^8$. In FIG. 3, reference characters M1, M2, M3, M4 . . . represent delivery timings at which the data Q1–Q9, are delivered out in series. FIG. 4 shows one delivery timing (e.g. M1) in an enlarged scale. One delivery timing comprises nine time slots from t1 to t9. The width of one time slot is determined by a tone source master clock pulse $\phi$11, $\phi$12. This tone source master pulse $\phi$11, $\phi$12 is of a frequency which is much higher than the highest frequency of every note. When the amplitude level of the data Q1 of the highest frequency has been inverted to "1" or "0", the time slot t1 first commences and a basic timing signal P is delivered out at this time slot t1. The basic timing signal P is "1" and there is no signal provided on an output line (e.g. 24-1) of the octaves multiplexed signal generator (e.g. 19-1) during at least eight time slots immediately before the time slot t1. Accordingly, the signal "1" which appears on the output line (24-1) after eight consecutive time slots at which the signal is "0" represents the basic timing signal P, i.e. arrival of the time slot t1.

The next time slot t2 is allotted to delivery of data representing a logical level of the data Q1 which is of the highest frequency. To the time slots t3–t9 are allotted data representing logical levels of the data Q2–Q8. Upon finishing of the time slot t9, the output line (24-1) is maintained at a level "0" until a next data delivery timing M2 starts.

In the octaves multiplexed signal generators 19-2 through 19-12 corresponding to the other notes (B–C#), the data is also provided in series on the respective output lines 24-2 through 24-12 in the order of P, Q1, Q2, Q3 . . . Q8. The octaves multiplexed signal generator 19-1 for the note C has another output line 24'-1. On this output line 24'-1 is provided serial data P, Q2, Q3 . . . Q9 for the note C of the lowest octave (i.e. C2). The data Q2-Q9 have weight of ½ of i.e., one octave lower, of the respective data Q1–Q8 delivered for the normal output line 24-1.

The multiplexed data (serial data) P, Q1–Q8, or P, Q2–Q9 corresponding to the respective notes (C–C#) outputted by the multiplexed data generators 19-1 through 19-12 is supplied to the note selectors 20 of the respective channels (ch1–ch7) through the output lines 24-1 through 24-12 and 24'-1. The note selector 20, the octave selector 21 and the tone waveform generator 22 are provided in each of the channels (ch1–ch7). In the note selector 20 of each channel, multiplexed data corresponding to the note of the key assigned to that channel is selected. In the octave selector 21 of each channel, the multiplexed data of a single note selected by the corresponding note selector 20 is arranged in parallel and its bit position is suitably shifted in accordance with the octave signal OC1–OC7 thereby to form an address signal for reading a waveform memory. The tone waveform generator 22 in each channel has a tone waveform memory and an envelope imparting circuit. Sampled amplitudes of a musical tone waveform are sequentially read from the tone waveform memory in response to the address signal provided by the octave selector 21 and a tone waveform signal is provided with an envelope in according with control by the envelope control circuit 18.

The envelope control circuit 18 produces on a time shared basis an attack time signal AT for setting an attack time of the envelope shape and a sustain time signal ST for setting a period of time during which a constant level is sustained after the rise of the tone with respect to each channel. The envelope control circuit 18 further produces on a time shared basis a release finish signal RF upon lapse of a certain period of time after release of the key with respect to each channel. The key code converter 16, the note selector 20 or the octave selector 21 is controlled by this release finish signal RF so as to inhibit generation of the tone signal in the channel in which the release finish signal RF has been generated.

The outputs of the tone waveform generator 22 are mixed together for each register of the same footage and thereafter are supplied to the tone coloring circuit 23. In the tone generator 14, a tone color of a female voice or a male voice can be provided by the tone coloring circuit 23. A female voice selection signal FV or a male voice selection signal MV is generated by operation of a female voice selection switch 25 or a male voice selection switch 26 and the tone color circuit 23 is operated in response to this signal FV or MV. The switches 25 and 26 are connected in such a manner that the switch 25 is given priority over the switch 26 in operation so that the female voice is given priority over the male voice when both are selected simultaneously.

The output of the tone color circuit 23 is supplied to a sound system 27. Outputs of the keyboard selection switch and the voice selection switch 25 are applied to a parallel-serial conversion circuit 28 where they are converted to serial data in accordance with the reference pulse SY with a pulse width of 1 microsecond which is generated every 54 microseconds in synchronization with the time slot "1" shown in FIG. 2 and the master clock pulse $\phi$1, $\phi$ with a period of 1 microsecond. The serial switch output Si is applied to the key code converter 16.

The circuit portions shown in FIG. 1 will now be described in detail with reference to FIGS. 5 through 13.

Figure 5:
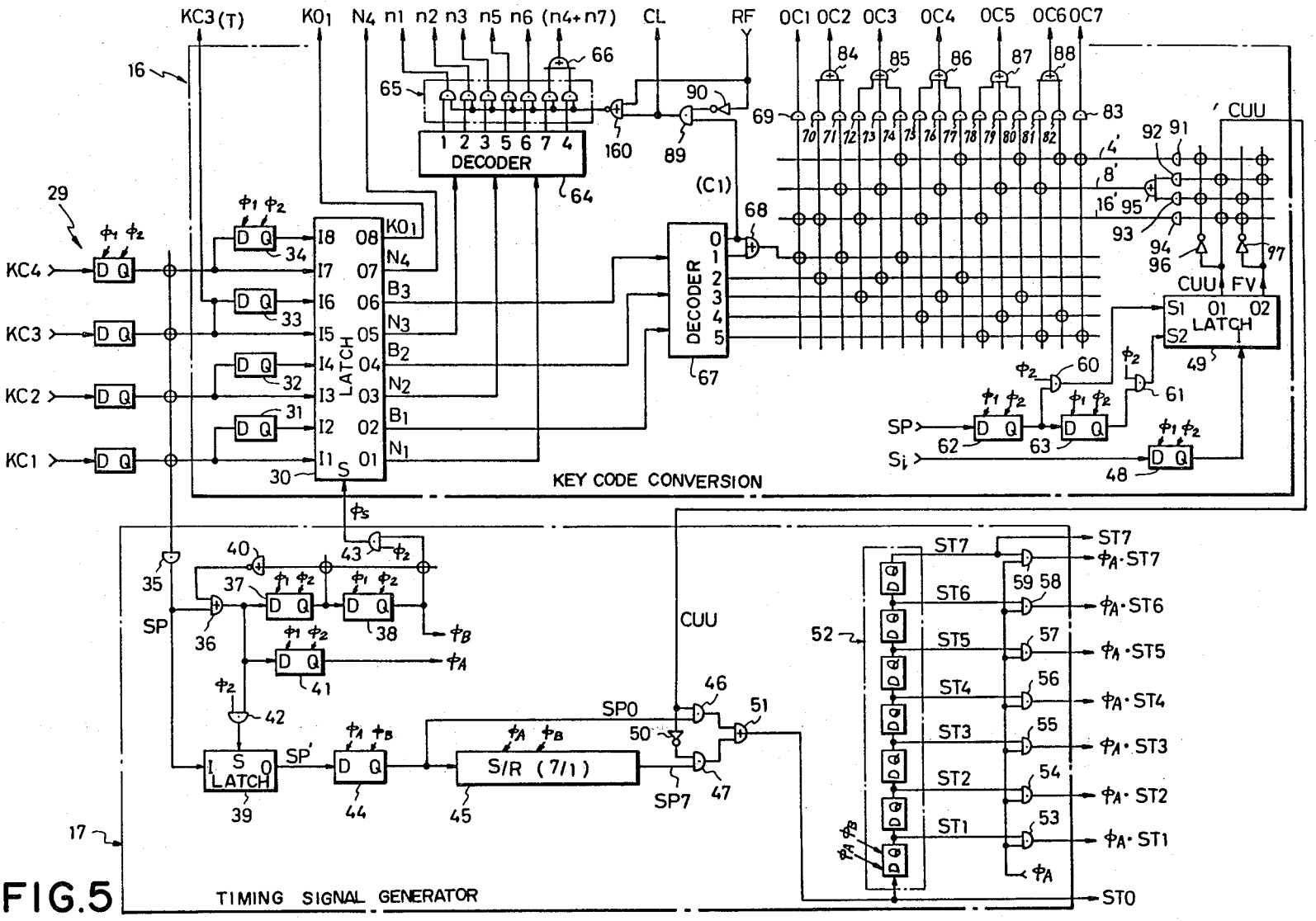
FIG. 5 is a block diagram showing details of a key code converting section and a timing signal generator shown in FIG. 1.
Figure 6:
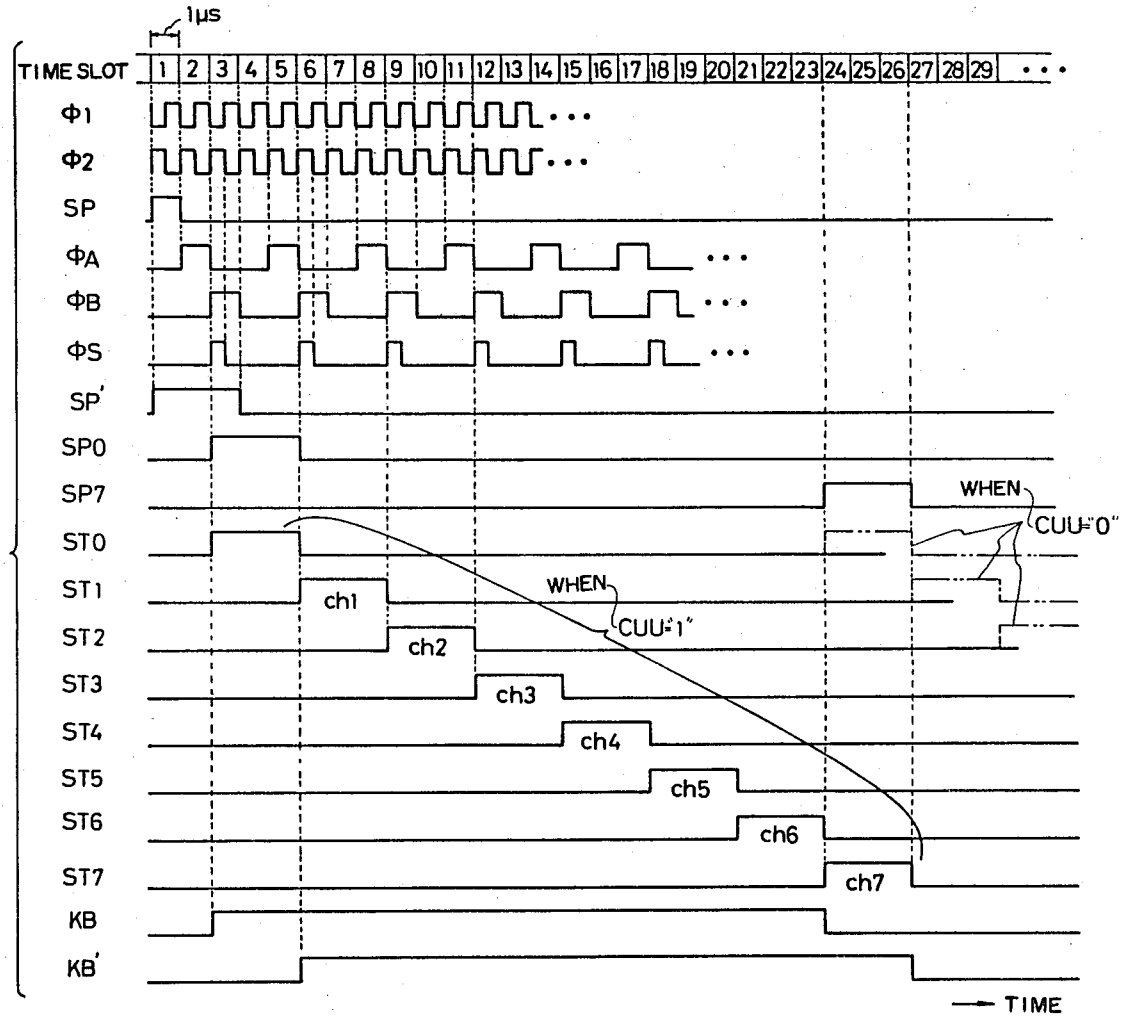
FIG. 6 is a time chart for explaining timewise relation between various control signals used in a tone generator shown in FIG. 1.

FIG. 5 shows the key code converter 16 and the timing signal generator 17 in detail. The data KC1, KC2, KC3 and KC4 supplied from the key code multiplexing circit 13 is delayed by 1 microsecond by a delay flip-flop groups 29 in accordance with the master clock pulse $\phi$1, $\phi$2 and thereafter is applied to a latch circuit 30 and delay flip-flops 31–34 of the key code converter 16 and also to an AND gate 35 of the timing signal generator 17. The AND gate 35 of a 4-input type detects states wherein the data KC1–KC4 are all "1", i.e. the timing at which the reference data "1111" is generated (the time slot "1" in FIG. 2). A pulse signal which is outputted by the AND gate 35 upon this detection is designated as a reference pulse SP (FIG. 6).

In the timing signal generator 17, the reference pulse SP is applied to a delay flip-flop 37 through an OR gate 36 and also to a data input (I) of a latch circuit 39. The output of the delay flip-flop 37 is applied to a delay flip-flop 38. Outputs of the two delay flip-flops 37 and 38 are fed back to the OR gate 36 through a NOR gate 40. An output of the OR gate 36 is further applied to a delay flip-flop 41 and an AND gate 42. The delay flip-flops 37, 38 and 41 are driven by the two-phase master clock pulse $\phi$1, $\phi$2. The period of the master clock pulse $\phi$1, $\phi$2 is 1 microsecond which is the same as the width of one time slot of the multiplexed data KC1–KC4. Accordingly, the OR gate 36 produces a signal "1" repeatedly every 3 microseconds after generation of the reference pulse SP in synchronization with the time slot "1". The pulse $\phi$A is produced by delaying the output signaL "1" of the OR gate 36 by 1 microsecond by the delay flip-flop 41 and the pulse $\phi$B is produced by delaying the output signal "1" of the OR gate 36 by 2 microseconds by the delay flip-flops 37 and 38. Accordingly, the pulse $\phi$A is generated with a period of 3 microseconds in correspondence to the time slots "2", "5", "8" . . . whereas the pulse $\phi$B is generated with a period of 3 microseconds in correspondence to the time slot "3", "6", "9" . . . as shown in FIG. 6.

The pulse $\phi$B is applied to an AND gate 43. The AND gate 43 receives at the other input thereof the master clock pulse $\phi$2 (FIG. 6). Accordingly, the AND gate 43 produces a pulse $\phi$s which is synchronized with the first half of each of the time slots "3", "6", "9" . . . . This pulse $\phi$s is applied to a strobe terminal S of the latch circuit 30. An AND gate 42 which receives the output of the OR gate 36 receives at the other input thereof the master clock pulse $\phi 2$ and the output of the AND gate 42 is applied to a strobe terminal S of a latch circuit 39. Accordingly, the reference pulse SP generated at the time slot "1" is latched by the latch circuit 39 in response to the output of the AND gate 42. When, however, a strobe pulse is given to the latch circuit 39 by the AND gate 42 at the first half of the time slot "4", the output of the AND gate 35 is no longer "0" so that the storage in the latch circuit is rewritten to "0". Accordingly, an output SP' of the latch circuit 39 is a signal "1" only at the time slots "1", "2" and "3".

The reference pulse SP' which is now expanded to the width of 3 microseconds is supplied to a delay flip-flop 44 from the latch circuit 39 and outputted from the delay flop-flop 44 as a signal SP0 (FIG. 6) after being delayed by 2 microseconds by the 2-phase pulse $\phi$A, $\phi$B. This output SPO of the delay flip-flop 44 is applied to a 7-stage/1-bit shift register 45 and also to an AND gate 66. The shift register 45 is shifted by the 2-phase pulse $\phi$A, $\phi$S and its final stage output SP7 is generated 21 microseconds after the signal SP0, i.e. at the time slots "24", "25" and "26". The output SP7 of the shift register 45 is applied to an AND gate 47.

The AND gate 46 is enabled when the upper keyboard is selected by the keyboard selection switch 15 (FIG. 1) whereas the AND gate 47 is enabled when the lower keyboard is selected by the switch 15. Accordingly, the switch output Si provided in series by the parallel-serial conversion circuit 28 (FIG. 1) is applied through a delay flip-flop 48 of the key code converter 16 to a latch circuit 49 where the signal data is converted to parallel data CUU and FV. The data CUU is "1" when the upper keyboard is selected by the keyboard selection switch 15 and "0" when the lower keyboard is selected by the switch 15. This data CUU is applied to the other input of the AND gate 46 and also to the other input of the AND gate 47 through an inverter 50.

If, accordingly, the tone generator 14 is used for generating the upper keyboard tones, the pulse SP0 is selected by the AND gate 46 and supplied to a shift register 52 through an OR gate 51 while the pulse SP7 is inhibited by the AND gate 47. If the tone generator 14 is used for generating the lower keyboard tones, the pulse SP0 is inhibited by the AND gate 46 while the pulse SP7 is selected by the AND gate 47 and supplied to a shift register 52 through an OR gate 51.

The shift register 52 is of a 7-stage/1-bit type consisting of seven delay flip-flops driven by the 2-phase pulse $\phi$A, $\phi$B and connected in cascade-connection. Outputs of the respective stages ST1–ST7 of the shift register 52 are supplied to AND gates 53–59. The pulse which is supplied to the shift register 52 from the OR gate 51 is denoted by reference characters ST0. The outputs ST1–ST7 of the respective stages are obtained by sequentially delaying this pulse ST0 by 3 microseconds one after another.

Periods of time during which the pulse ST0 and ST1–ST7 are present differ depending upon the selected keyboard. If the upper keyboard is selected (i.e. the data CUU is "1"), the pulse SP0 coincides with the pulse ST0 and the pulses ST1 through ST7 are successively generated during the period of the time slots "6" through "26" as shown in FIG. 6. If the lower keyboard is selected (i.e., the data CUU is "0"), the pulse SP7 coincides with the pulse ST0, though this is not shown in FIG. 6, and the pulses ST1–ST7 are successively generated during the period of time slots "27" through "47".

The AND gates 53–59 receive at the other inputs thereof the pulse $\phi$A. Accordingly, outputs pulses $\phi$A·ST1, $\phi$A·ST2, $\phi$A·ST3, $\phi$A·ST4, $\phi$A·ST5, $\phi$A·ST6 and $\phi$A·ST7 of the AND gates 53–59 are successively generated at the time slots "8", "11", "14", "17", "20", "23" and "26" when the upper keyboard is selected whereas these output pulses are successively generated at the time slots "29", "32", "35", "38", "41", "44" and "47" when the lower keyboard is selected.

In the latch circuit 49, an output of an AND gate 60 is applied to a strobe terminal S1 for latching the keyboard selection signal CUU from the switch output Si which has been converted to serial data and an output of an AND gate 61 is applied to a strobe terminal S2 for latching the female voice selection signal FV. In the parallel-serial conversion circuit 28 (FIG. 1), the output of the switch 15 (i.e., the signal CUU) is provided at a time slot next to the reference pulse SY and the output of the switch 25 (i.e., the signal FV) is provided at a further next time slot. The reference pulse SY is generated at the time slot "1" which is preceding to time when the data KC1–KC4 is delayed by the delay flip-flop 29. Accordingly, in the serial switch output Si, the signal CUU is allotted to the time slot "2" and the signal FV to the time slot "3". In the key code converter 16, the switch output Si is delayed by 1 microsecond by a delay flip-flop 48 for synchronization with the delay of the data KC1–KC4 by the delay flip-flop group 29. The reference pulse SP(1 microsecond delayed relative to the pulse SY) generated by the AND gate 35 is delayed by 1 microsecond by a delay flip-flop 62 and thereafter is supplied to the AND gate 60 and a delay flip-flop 63. The pulse which is further delayed by 1 microsecond by the delay flip-flop 63 is supplied to the AND gate 61. The AND gates 60 and 61 receive the pulse $\phi 2$ at the other inputs thereof. Accordingly, the AND gate 60 produces an output "1" at a first half of the time slot "2". A this time, the keyboard selection signal CUU is provided from the delay flip-flop 48 to the data input I of the latch circuit 49 so that this signal CUU is latched at a latch position ($O_1$) of the latch circuit 49. The AND gate 61 produces an output "1" at a first half of the time slot "3". At this time, the female voice selection signal FV is provided from the delay flip-flop 48 to the data input terminal I of the latch circuit 49 so that this signal FV is latched at a latch position ($O_2$) of the latch circuit 49.

A pulse $\phi$s (FIG. 6) from the AND gate 43 is applied to a strobe terminal of an 8-bit latch circuit 30 in the key code converter 16. The data KC1–KC4 is applied to data inputs I1, I2, I5 and I7 of the latch circuit 30 whereas the data KC1–KC4 delayed by 1 microsecond by the delay flip-flops 31–34 is applied to data inputs I2, I4, I6 and I8 of the latch circuit 30. The pulse $\phi$s for strobe is generated at the time slots "3", "6", "9", "12" . . . , i.e. the time slots at which the note code N1–N4 is delivered out as the data KC1–KC4 as will be understood from FIG. 2. When the pulse $\phi$s is generated, the delay flip-flops 31–34 output octave code B1–B3 and the key-on signal KO1 (FIG. 2) which have been supplied as the data KC1–KC4 at the immediately preceding time slots "2", "5", "8", "11" . . . .

Accordingly, the note code N1–N4, the octave code B1–B3 and the key-on signal KO1 of the same channel are latched by the latch circuit 30 at the timing of the pulse $\phi$s.

For example, the note code N1–N4, the octave code B1–B3 and the key-on signal KO1 of the first channel ch1 of the upper keyboard is latched by the latch circuit 30 at the time slot "6" and held therein for 3 microseconds up to the time slot "8". The key code N1–N4, B1–B3 and the key-on signal KO1 of the second channel ch2 of the upper keyboard are latched by the latch circuit 30 at the time slot "9" and held therein for 3 microseconds until the time slot "11". Thus, the contents of the data N1–N4, B1–B3 and KO1 in the latch circuit 30 are rewritten every 3 microseconds in the order of the channel ch1, ch2 . . . ch7. As will be apparent from FIG. 6, the period of time during which the data N1–N5, B1–B3 and KO1 of the respective channels ch1–ch7 is latched coincides with the timing of generation of the outputs ST1–ST7 of the respective stages of the shift register 52.

Three bits N1–N3 counting from the least significant bit of the note code N1–N4 latched by the latch circuit 30 are inputted to a decoder 64. The decoder 64 produces note signals n1–N7 as shown in Table 2 in accordance with the value of the inputted code N1–N3.

TABLE 2

| input bit | | | output line of decoder 64 | | note name |
|---|---|---|---|---|---|
| N3 | N2 | N1 | | | |
| 0 | 0 | 1 | n1 | C# | G |
| 0 | 1 | 0 | n2 | D | G# |
| 0 | 1 | 1 | n3 | D# | A |
| 1 | 0 | 1 | n5 | E | A# |
| 1 | 1 | 0 | n6 | F | B |
| 1 | 1 | 1 | n7 | F# | |
| 1 | 0 | 0 | n4 | C | |

The note signals n1–n7 outputted from the decoder 64 are supplied to the note selector 20 through a gate 65. The note signal n7 corresponding to the note F# and the note signal n4 corresponding to the note C are combined by an OR gate 66 and thereafter are supplied to the note selector 20. Since the note name cannot be sufficiently discriminated by the note signals n1–n7 only, the most significant bit N4 of the code is also supplied from the latch circuit 30 to the note selector 20.

The octave code B1–B3 latched by the latch circuit 30 is supplied to a decoder 67. The decoder 67 produces decoded outputs in accordance with values 0, 1, 2, 3, 4, 5 of the octave code B1–B3. Relationship between the octave codes B1–B3 and the octave range is as shown in previous Table 1. The output (0) of the decoder 67 corresponding to the lowest octave (including only the note C2) and the output (1) of the decoder 67 corresponding to the octave including the notes from C#2 to C3 (hereinafter referred to as the first octave) are applied to AND gates 69, 71 and 74 through an OR gate 68. The output (2) of the decoder 67 corresponding to the octave including the notes from C#3 to C4 (hereinafter referred to as the second octave) is applied to AND gates 70, 73 and 77. The output (3) of the decoder 67 corresponding to the octave including the notes from C#4 to C5 (hereinafter referred to as the third octave) is applied to AND gates 72, 76 and 80. The output (4) of the decoder 67 corresponding to the octave including the notes from C#5 to C6 (hereinafter referred to as the fourth octave) is applied to AND gates 75, 79 and 82. The output (5) of the decoder 67 corresponding to the octave including the notes from C#6 to C7 (hereinafter referred to as the fifth octave) is applied to AND gates 78, 81 and 83.

The output of the AND gate 69 and the output of the AND gate 83 are supplied to the octave selector 21 as the octave signals OC1 and OC7, respectively. The outputs of the AND gates 70 and 71 are applied to an OR gate 84, the outputs of the AND gates 72, 73 and 74 to an OR gate 85, the outputs of the AND gates 75, 76 and 77 to an OR gate 86, the outputs of the AND gates 78, 79 and 80 to an OR gate 87 and the outputs of the AND gates 81 and 82 to an OR gate 88. The outputs of these OR gates 84–88 are supplied to the octave selector 21 as the octave signals OC2–OC6.

The decoder outputs for the lowest octave (C2) and the first octave are combined by the OR gate 68 processing them as the same octave (i.e., for processing the lowest note C2 as the first octave). For this purpose, the data Q1–Q8 for a normal C note is outputted from the octaves mutiplexed signal generator 19-1 through the line 24-1 and the data Q2–Q9 which is one octave lower (i.e. for the lowest note C2) is outputted through the line 24'-1.

The output (0) of the decoder 67 corresponding to the lowest octave is supplied through an AND gate 89 to the note selector 20 as the note signal CL representing the lowest note C2. To the other input of the AND gate 89 is supplied the release finish signal RF from envelope control circuit 18 (FIG. 1) through an inverter 90.

The AND gates 69-83 and the OR gates 84-88 are circuits provided for changing the tone range to be played in accordance with the operation modes of the keyboard selection switch 15 and the female voice selection switch 25. The keyboard selection signal CUU latched by the latch circuit 49 is applied to AND gates 92 and 94 and a signal obtained by inverting the signal CUU by an inverter 96 is applied to AND gates 91 and 93. The female voice selection signal FV latched by the latch circuit 49 is applied to the AND gates 91 and 92 and a signal obtained by inverting this signal FV by an inverter 97 is applied to AND gates 93 and 94. The output of the AND gate 91 is supplied to the AND gates 74, 77, 80, 82 and 83 as a 4-foot register selection signal 4'. The outputs of the AND gates 92 and 93 are supplied to the AND gates 71, 73, 76, 79 and 81 as an 8-foot register selection signal 8' through an OR gate 95. The output of the AND gate 94 is supplied to the AND gates 61, 70, 72, 75, and 78 as a 16-foot register selection signal 16'.

Accordingly, the octave signals OC1–OC7 are determined as shown in the following Table 3 by states of the outputs (0–5) of the decoder 67 and the signals CUU and FV.

TABLE 3

| | | output of decoder 67 (octave range) | | | | |
|---|---|---|---|---|---|---|
| | | 0 1 | 2 | 3 | 4 | 5 |
| CUU | FV | C2–C3 | C#3–C4 | C#4–C5 | C#5–C6 | C#6–C7 |
| 0 | 1 | 0C3 | 0C4 | 0C5 | 0C6 | 0C7 |
| 1 | 1 | 0C2 | 0C3 | 0C4 | 0C5 | 0C6 |
| 0 | 0 | 0C2 | 0C3 | 0C4 | 0C5 | 0C6 |
| 1 | 0 | 0C1 | 0C2 | 0C3 | 0C4 | 0C5 |

The change in the tone range to be played is achieved when the following conditions are satisfied: (1) when the female voice has been selected (FV is "1"), the tone range to be played is one octave higher than in the case where the male voice has been selected (FV is "0") and;

(2) when the lower keyboard has been selected (CUU is "0"), the tone range to be played is one octave higher than in the case where the upper keyboard has been selected (CUU is "1"). The reason for making the tone range of the lower keyboard one octave higher than the tone range of the upper keyboard is that it is normal for the player to play the upper keyboard with a right hand and the lower keyboard with a left hand when both keyboards are played together and, accordingly, the tone range of the lower keyboard naturally tends to become lower than that of the upper keyboard.

Figure 7:
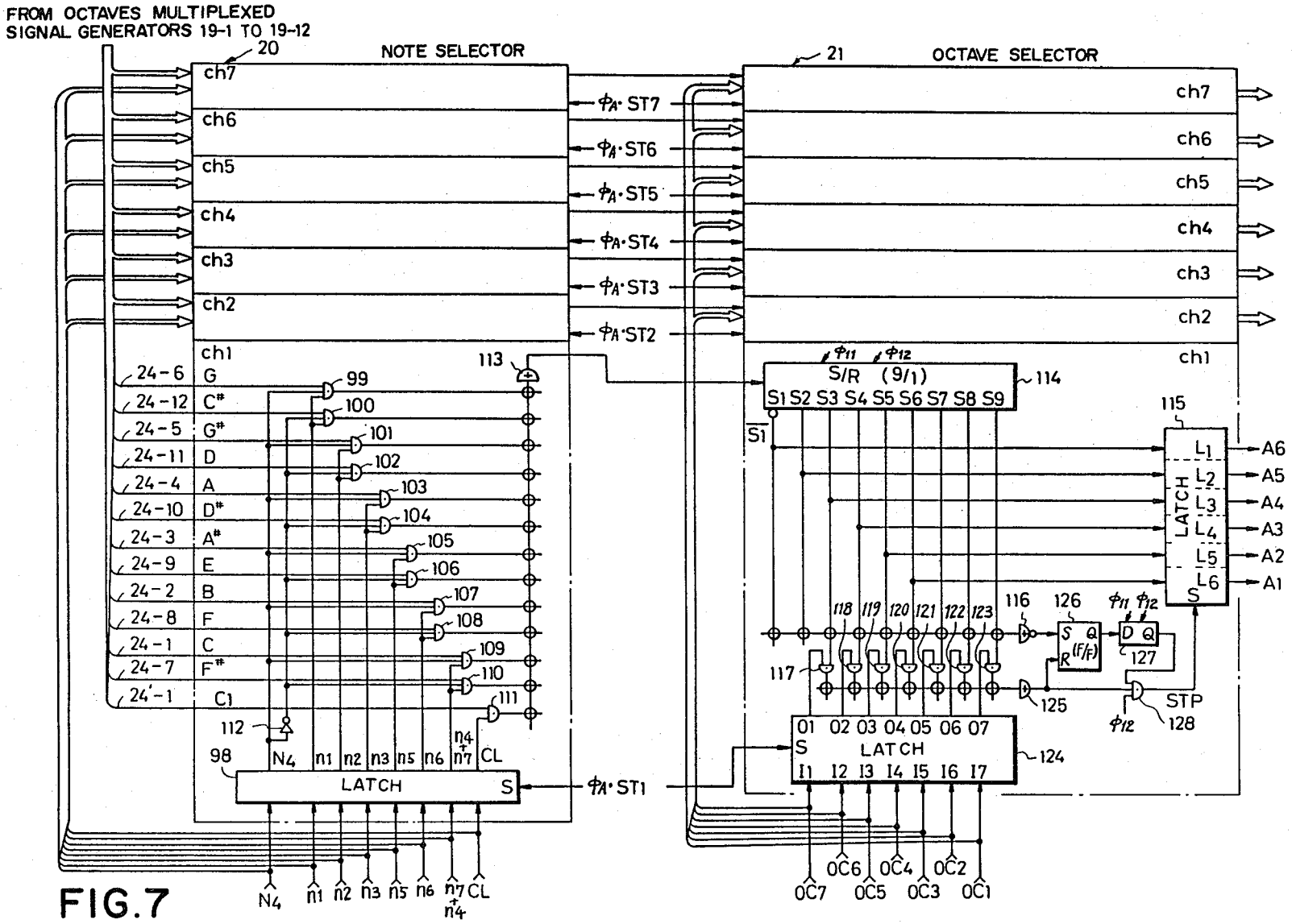
FIG. 7 is a block diagram showing details of a note selector and an octave selector shown in FIG. 1.

FIG. 7 shows the note selector 20 and the octave selector 21 in detail with respect to the first channel ch1. The note selector 20 and the octave selector 21 for other channels ch2–ch7 which are omitted from the figure are of the same construction as those for the first channel ch1. Description will therefore be made about the first channel ch1 with reference to FIG. 7. Description will be made on the assumption that the tone generator 14 is used for generating the upper keyboard tones.

The note signals n1, n2, n3, n5 and n6 outputted from the decoder 64 of the key code converter 16 through the gate 65, the note signal (n4+n7) outputted from the decoder 64 through the OR gate 66, the signal CL representing the lowest note C2 outputted from the AND gate 89 and the most significant bit N4 of the note code outputted from the latch circuit 30 are applied to a latch circuit 98 of the note selector 20. The latch circuit 98 for the first channel ch1 receives at its strobe terminals S the pulse $\phi$A·ST1 from the AND gate 53 (FIG. 5) of the timing signal generator 17. This pulse $\phi$A·ST1 is generated in synchronization with the time slot "8" (FIG. 6) in the case of the upper keyboard. Since, as described above, the note code N1–N4, the octave code B1–B3 and the key-on signal KO1 of the tone assigned to the first channel ch1 of the upper keyboard are outputted from the latch circuit 30 of the key code converter 16 for 3 microseconds of the time slots "6", "7" and "8", the signals n1–n7, "7" and "8", the signals n1–n7, n4 and CL representing the note name of the tone assigned to the first channel ch1 is latched by the latch circuit 98 at the timing of the pulse $\phi$A·ST1. This latch circuit 98 is provided for picking up a signal of the corresponding channel from the signal n1–n7, n4 and CL supplied on a time shared basis from the key code converter 16 and converting it to a sustained signal.

The output of the latch circuit 98 is applied to AND gates 99-111 for selecting the superposed frequency data.

The AND gates 99-110 receive at the other inputs thereof the multiplexed data (P·Q1–Q8) corresponding to the respective notes C—C# provided by the octaves multiplexed signal generators 19-1 through 19-12 via the lines 24-1 through 24-12 separately as shown in the figure. The AND gate 111 receives at the other input thereof the multiplexed data (P, Q2–Q9) corresponding to the lowest note C2 through the line 24'-1. The most significant bit N4 of the note code outputted by the latch circuit 98 is applied to the AND gates 99, 101, 103, 105, 107 and 109 and a signal "1" is applied to these AND gates when the note name of the tone assigned to the particular channel is one of G, G#, A, A#, B and C. A signal obtained by inverting the signal N4 outputted from the latch circuit 98 by an inverter 112 is applied to the AND gates 100, 102, 104, 106, 108 and 110 and a signal "1" is supplied to these AND gates when the note name of the tone assigned to the channel is one of C# D, D#, E, F and F#. The signal n1 outputted from the latch circuit 98 is supplied to the AND gates 99 and 100, the signal n2 to the AND gates 101 and 102, the signal n3, to the AND gates 103 and 104, the signal n5 to the AND gates 105 and 106, the signal n6 to the AND gates 107 and 108 and the signal (n4+n7) to the AND gates 109 and 110, respectively. Accordingly, one of the AND gates 99 through 110 is enabled in accordance with combination of the note signals n1–n7 and the bit N4 and thereby selects multiplexed data of one note name from among the multiplexed data of the twelve note names C#–C. The signal CL representing the lowest tone C2 outputted from the latch circuit 98 is supplied to the AND gate 111. Accordingly, when the tone assigned to the channel is the lowest tone C2, the AND gate 111 is enabled to select the multiplexed data (P, Q2–Q9) exclusively for the note C2. The outputs of the AND gates 99–111 are supplied to a shift register 114 in the octave selector 21 corresponding to the channel (ch1) through an OR gate 113.

The note selectors 20 for the respective channel are different from each other only in that one of the pulses $\phi$A·ST1–$\phi$A·ST7 corresponding to their specific channel is supplied to a strobe terminal of the latch circuit 98. More specifically, the pulse $\phi$A·ST2 from the AND gate 54 (FIG. 5) of the timing signal generator 111 is supplied to the latch circuit 98 of the note selector 20 of the second channel ch2. The pulse $\phi$A·ST3 from the AND gate 55 to that of the third channel, the pulse $\phi$A·ST4 from the AND gate 56 to that of the fourth channel . . . the pulse $\phi$A·ST7 from the AND gate 59 to that of the seventh channel. By virtue of this arrangement, each of the note selectors 20 of the respective channels ch1–ch7 can select the data corresponding to the note name of the tone assigned to its channel.

The octave selector receives the multiplexed data (P, Q1–Q8 or P, Q2–Q9) of a single note selected by the note selector 20, converts this data to parallel data in response to the octave signal OC1–OC7. The data P, Q1–Q8 (or P, Q2–Q9) is applied through an OR gate 113 of the note selector 2o to the first stage S1 of a 9-stage/1-bit shift register 114 of a series-input/parallel-output serial shift type and is sequentially shifted from the first stage S1 to the ninth stage S9. Accordingly, parallel data formed on the basis of the data P, Q1–Q8 (or Q2–Q9) is outputted from the output terminal of each stage of the shift register 114. Since the data is supplied intermittently at the timing of the timing signal P, the data which has been converted to parallel data by the shift register 114 is latched by a latch circuit 115 to form sustained signals.

The data Q1–Q9 latched by the latch circuit 115 are used as address signals for reading out the waveforms stored in the tone waveform memory.

The shift register 114 is driven by the some clock pulse as the clock pulses $\phi$11 and $\phi$12 used in the octave multiplexed signal generators 19-1 through 19-12. The multiplexed data are loaded in the shift register 114 in the order of P, Q1, Q2, Q3, Q4, Q5, Q6, Q7 and Q8. Assuming that the basic timing signal P is loaded in the first stage S1 of the shift register 114 at timing t1'. contents of data in the respective stages S1–S9 of the shift register 114 up to timing t9' are shown in FIG. 8(a).

An inverted output $\overline{S1}$ of the first stage S1 and the output signals of the second stage S2 through the ninth stage S9 of the shift register 114 are applied to a NOR gate 116. This NOR gate 116 is provided for detecting the basic pulse signal P, i.e., for detecting arrival of the data Q1–Q8. The outputs of the third stage S3 through the ninth stage S9 are applied also to AND gates 117-123 which are provided for shifting the bit position of the data Q1–Q8 (or Q2–Q9) converted to parallel data by the shift register 114 in accordance with the octave signals OC1–OC7. After shift control operation, the parallel data Q1–Q8 (or Q2–Q9) are maintained in the latch circuit 115.

The octave signals OC1–OC7 supplied in a time shared fashion from the key code converter 16 are supplied to data inputs of a latch circuit 124. The latch circuit 124 receives, like the latch circuit 98 of the note selector 20, the pulse $\phi$A·ST1 corresponding to the first channel ch1 at its strobe terminal S. To the latch circuits 124 of the other channels ch2–ch7 are supplied pulses $\phi$A·ST2–$\phi$A·ST7 corresponding to their channels. The pulse $\phi$A·ST1 is generated when the octave signals OC1–OC7 of the tone assigned to the first channel ch1 (one of the signals OC1–OC7 is "1" and the rests are "0") is being applied to the latch circuit 124 and the octave signals OC1–OC7 of the tones assigned to the first channel ch1 is latched by the latch circuit 124. The octave signals OC1–OC7 assigned to the other channels ch2–ch7 are likewise latched by the latch circuit 124 in the octave selectors 21 of the respective channels ch2–ch7 in response to the pulses $\phi$A·ST2–$\phi$A·ST7.

The octave signals OC1–OC7 latched by the latch circuit 124 are applied to the AND gates 117–123 one after another from the octave signal OC7 for the highest octave to the lower octave side. In this case, only a single octave signal in the octave signal OC1–OC7 which corresponds to the octave range of the tone assigned to the specific channel is "1" so that a single AND gate (one of the AND gates 117–123) corresponding to the single octave signal which is "1" (one of the signals OC1–OC7) only is enabled. When the basic timing signal P has been shifted to a stage (one of the stages S3–S9) of the shift register 114 corresponding to the enabled AND gate, this AND gate (one of the AND gates 117–123) gates out a signal "1" which is applied to an OR gate 125.

The arrival of the data Q1–Q8 (or Q2–Q8) to the shift register 114 is detected in the following manner.

Since the data Q1–Q8 (or Q2–Q9) appear after the basic timing signal P, no data appears at least during 8 bits immediately before appearance of the basic timing signal P (i.e. a state "0"). Accordingly, when the basic timing signal P has been loaded in the first stage S1 of the shift register 114, the outputs of the second stage S2 through the ninth stage S9 representing the state of the signal for 8 bit time immediately before the loading of the signal P are all "0". This timing is designated by t'1 in FIG. 8. The inverted output $\overline{S1}$ of the first stage S1 of the shift register 114 is turned to "0" by loading of the basic timing signal P into the first stage S1. The NOR gate 116 which receives the inverted output $\overline{S1}$ of the first stage S1 and the outputs of the second stage S2 through the ninth stage S9 produces an output "1" at the time point of t1'.

Figure 8:
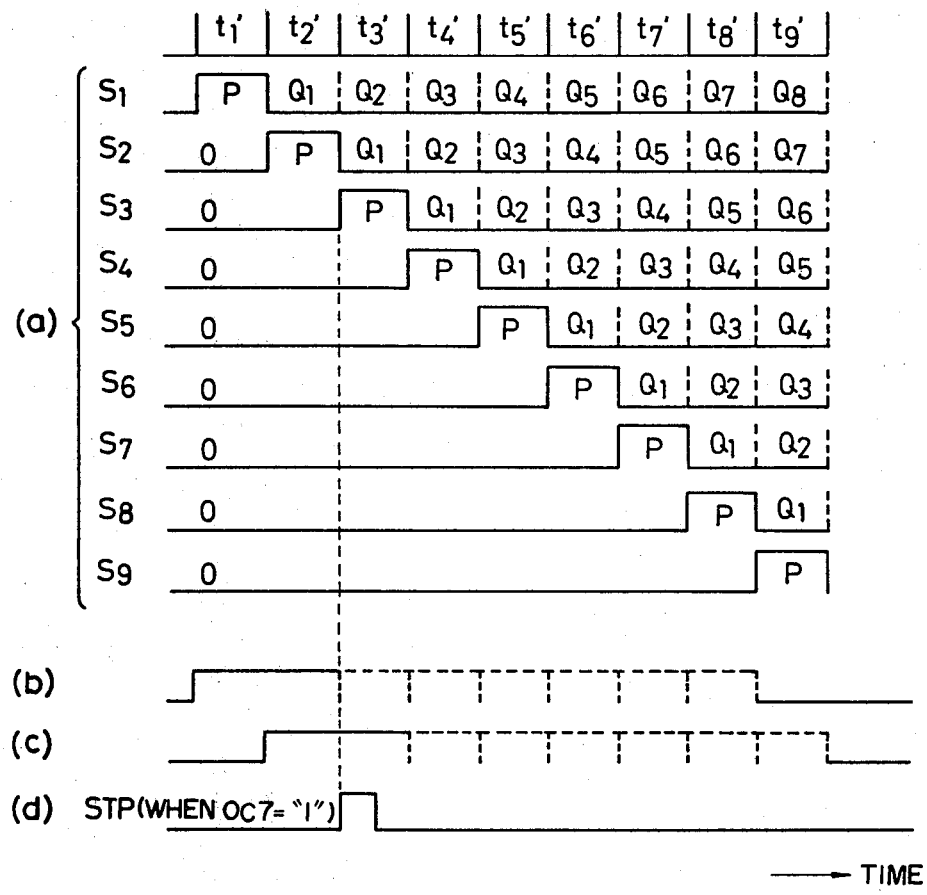
FIG. 8 is a time chart for explaining operation of the octave selector shown in FIG. 7.

The output "1" of the NOR gate 116 is applied to a set input S of a set-reset type flip-flop 126. The flip-flop 126 thereby is brought into a set state as shown in FIG. 8(*b*) and a set output thereof is applied to an AND gate 128 after being delayed by one it time by a delay flip-flop 127 as shown by FIG. 8(*c*). Thus the AND gate 128 is set in an operable state.

Outputs of the above described AND gates 117 through 123 are applied to the other input of the AND gate 128 through the OR gate 125 and also to a reset input R of the flip-flop 126. The basic timing signal P always precedes the data Q1–Q8 (or Q2–Q9) and, accordingly, a first reset signal is applied to the flip-flop 126 when the output "1" is produced by the AND gates 117 through 123 in response to this basic timing signal P. The flip-flop 126 thereby is reset and the AND gate 128 is enabled so that the output "1" of the AND gate 128 is applied to a strobe terminal S of the latch circuit 115 at the timing of the clock pulse $\phi$12. Upon resetting of the flip-flop 126, the output of the delay flip-flop 127 becomes a signal "0" one bit later so that the AND gate 128 is not enabled thereafter even if the OR gate 125 produces an output "1". Accordingly, a strobe pulse STP applied to the latch circuit 115 from the AND gate 128 appears only for one bit time.

The timing at which strobe pulse STP is produced is determined by the octave signal OC1–OC7.

If the octave signal OC1 representing the highest octave is "1", the AND gate 117 is enabled when the basic timing signal P has entered the third stage S3 of the shift register 114 and the strobe pulse STP is generated at the timing t3' (FIG. 8(d)). At this time, the stages S1 and S2 of the shift register 114 are loaded with the data Q2, Q1 (FIG. 8(a)). Accordingly, the data Q2, Q1, is loaded in the latch circuit 115. It should be noted, however, that an inverter output $\overline{S1}$ of the first stage S1 is loaded in the latch circuit 115 so that, precisely speaking, the data loaded in the latch circuit 115 is $\overline{Q2}$, Q1.

The latch circuit 115 has six latch positions L1–L6, the latch position L1 corresponding to weight of the most significant bit and the latch position L6 corresponding to weight of the least significant bit. The inverted output $\overline{S1}$ of the first stage S1 and the outputs of the second stage S2 through the sixth stage S6 of the shift register 114 are applied to the latch positions L1–L6 of the latch circuit 115. The outputs of the respective latch positions of the latch circuit 115 are designated respectively by A6, A5, A4, A3, A2 and A1, the output A6 being the most significant bit and the output A1 being the least significant bit.

The data Q1 (or Q2) appears at the top of the data Q1–Q8. The basic timing signal P is loaded in a stage of the shift register 114 next to the stage in which the state Q1 (or Q2) is loaded. The basic timing signals P which indicates the timing at which the data is present is unnecessary in a case where the data Q1–Q8 (or Q2–Q9) only is latched in parallel. In the present embodiment, however, the basic timing signal P also is latched by the latch circuit 115. If, accordingly, the strobe pulse STP is generated at the timing t3', the data $\overline{Q2}$, Q1, P are latched in the latch positions L1, L2 and L3 of the latch circuit 115.

Whenever the data Q11–Q8 is applied to the octave selector 21 with the basic timing signal P, the strobe pulse STP is generated to rewrite storage of the latch circuit 115. Values of the output signals A6–A1 of the latch circuit 115 change every time logical values of the frequency data Q1–Q8 (or Q2–Q4) change. In the above described manner, the latch circuit 115 produces binary signals A6–A1 which are obtained by sustaining the frequency data Q1–Q8 (or Q2–Q9) in parallel and shifting the bit positions thereof in accordance with the octave signal OC1–OC7.

When the octave signal OC6 is "1", the AND gate 118 is enabled and the strobe pulse STP is generated at timing t4 (FIG. 8). The strobe pulse STP is generated at timing t5' when the octave signal OC5 is "1", at timing t6' when the octave signal OC4 is "1", at timing t7' when the octave signal OC3 is "1", at timing t8' when the octave signal OC2 is "1" and at timing t9' when the octave signal OC1 is "1".

Accordingly, states of the data Q1–Q8 (or Q2–Q4) latched by the latch circuit 115 in accordance with the octave signals OC1–OC7, i.e., states of the output signals A6–A1 of the latch circuit 115 are as shown in the following Table 4:

TABLE 4

| | | | | | Latch circuit 115 | |
|---|---|---|---|---|---|---|
| | | (MSB) | | | | (LSB) |
| Octave | A6 | A5 | A4 | A3 | A2 | A1 |
| OC7 | $\overline{Q2}$ | Q1 | "1" (P) | "0" | "0" | "0" |
| OC6 | $\overline{Q3}$ | Q2 | Q1 | "1" (P) | "0" | "0" |
| OC5 | $\overline{Q4}$ | Q3 | Q2 | Q1 | "1" (P) | "0" |
| OC4 | $\overline{Q5}$ | Q4 | Q3 | Q2 | Q1 | "1" (P) |
| OC3 | $\overline{Q6}$ | Q5 | Q4 | Q3 | Q2 | Q1 |
| OC2 | $\overline{Q7}$ | Q6 | Q5 | Q4 | Q3 | Q2 |
| OC1 In case of Cl | $\overline{Q8}$ | Q7 | Q6 | Q5 | Q4 | Q3 |
| OC3 | $\overline{Q7}$ | Q6 | Q5 | Q4 | Q3 | Q2 |
| OC2 | $\overline{Q8}$ | Q7 | Q6 | Q5 | Q4 | Q3 |
| OC1 | $\overline{Q9}$ | Q8 | Q7 | Q6 | Q5 | Q4 |

Figure 9:
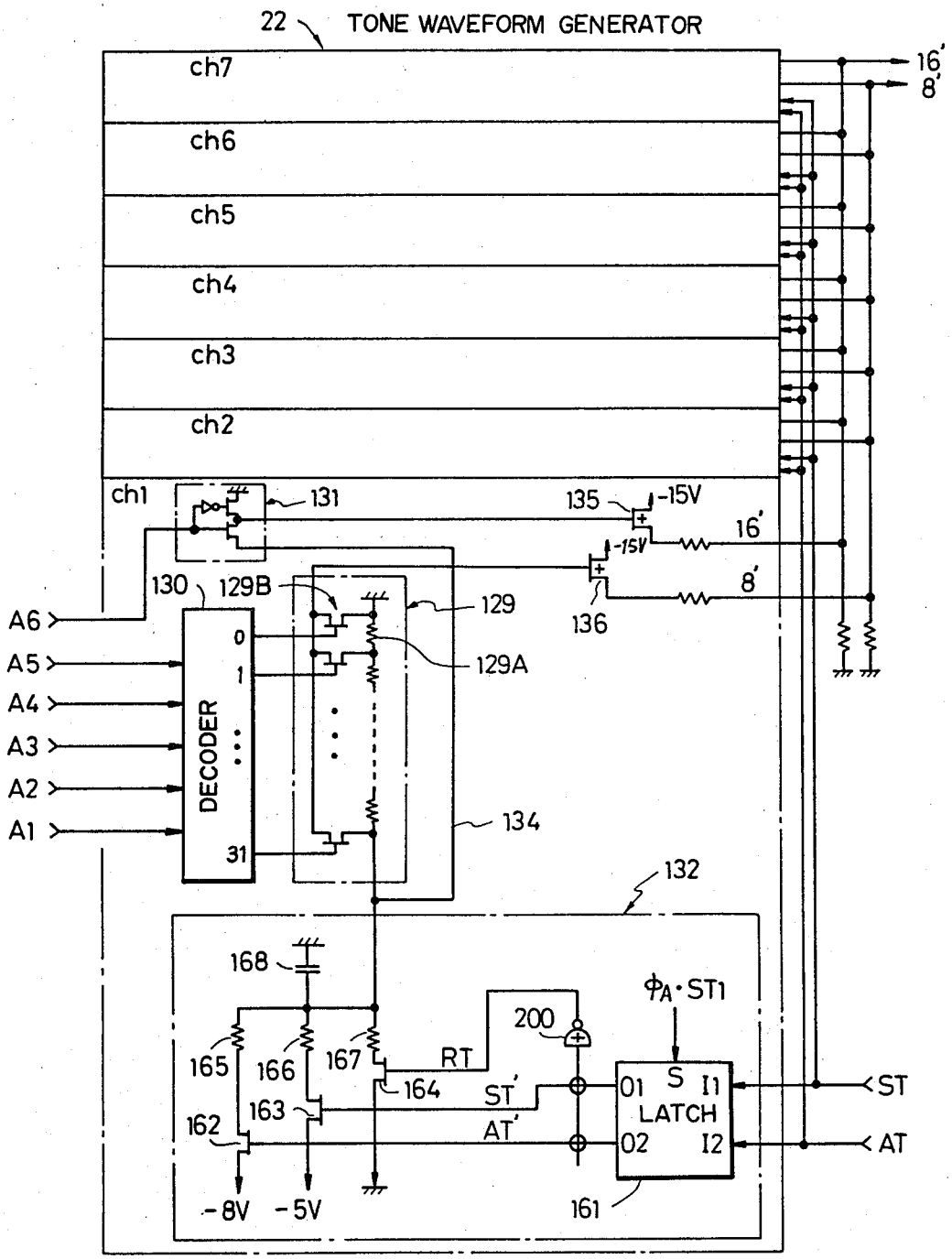
FIG. 9 is a circuit diagram showing details of tone waveform generator shown in FIG. 1.

FIG. 9 shows the tone waveform generator 22 in detail. In FIG. 9, the first channel ch1 only is shown in detail but the other channels are of the same construction. The tone waveform generator 22 comprises a waveform memory 129, a decoder 130, a gate 131 for a rectangular wave and an envelope imparting circuit 132.

The five bits A5–A1 counting from the least significant bit A1 among the signal A6–A1 supplied from the latch circuit 115 of the octave selector 21 are applied to the decoder 130 where they are used as an address signal for reading the waveform memory 129. The most significant bit A6 is applied to the gate 131 where it is used as a source signal for generating a rectangular wave signal of a 16-foot register.

The waveform memory 129 includes a resistance dividing circuit 129A having 32 voltage dividing points and a gate 129B for delivering out output voltages at the respective voltage dividing points in response to the outputs of the decoder 130 and stores one cycle of a sawtooth waveform. Accordingly, one cycle of the sawtooth waveform is read out for a period during which the address signal A5–A1 changes from "00000" to "11111". The read out sawtooth waveform signal is taken out as a tone signal of an 8-foot register through a buffer gate 136 and supplied to the tone coloring circuit 23 (FIG. 1) after being mixed with signals of the other channels ch2–ch7.

The gate 131 gate-controls voltage on an envelope shape supply line 134 in accordance with the state "1"or "0" of the signal A6 thereby to generate a rectangular waveform signal imparted with an envelope. This rectangular waveform signal is taken out as tone signal of a 16-foot register through a buffer gate 135 and supplied to the tone coloring circuit after being mixed with the signals of the other channels. The voltage on the envelope shape supply line 134 is applied also to the resistance dividing circuit 129A so that the same envelope is imparted to the sawtooth waveform signal read from the waveform memory 129.

Since the weight of the most significant bit A5 of the address signal A5–A1 is of the weight of the signal A6, frequency of the sawtooth waveform signal is double that of the rectangular waveform signal so that relation between the two waveforms is that of an 8-foot register and a 16-foot register.

The envelope imparting circuit 132 generates an envelope shape consisting of four portions of "attack", "decay", "sustain" and "release" in response to an attack time signal AT and a sustain time signal ST provided by the envelope control signal 18 (FIG. 1) and supplies this envelope shape to the resistance dividing circuit 129A and the gate 131 the line 134. This envelope shape is generally referred to as "ADSR" shape in which a portion which rises from the start of depression of a key to a peak level is called "attack", a portion which falls from the peak to a sustain level "decay", a portion which maintain a sustained level "sustain" and a portion which falls from the sustain level to a 0 level after release of the key "release".

Figure 10:
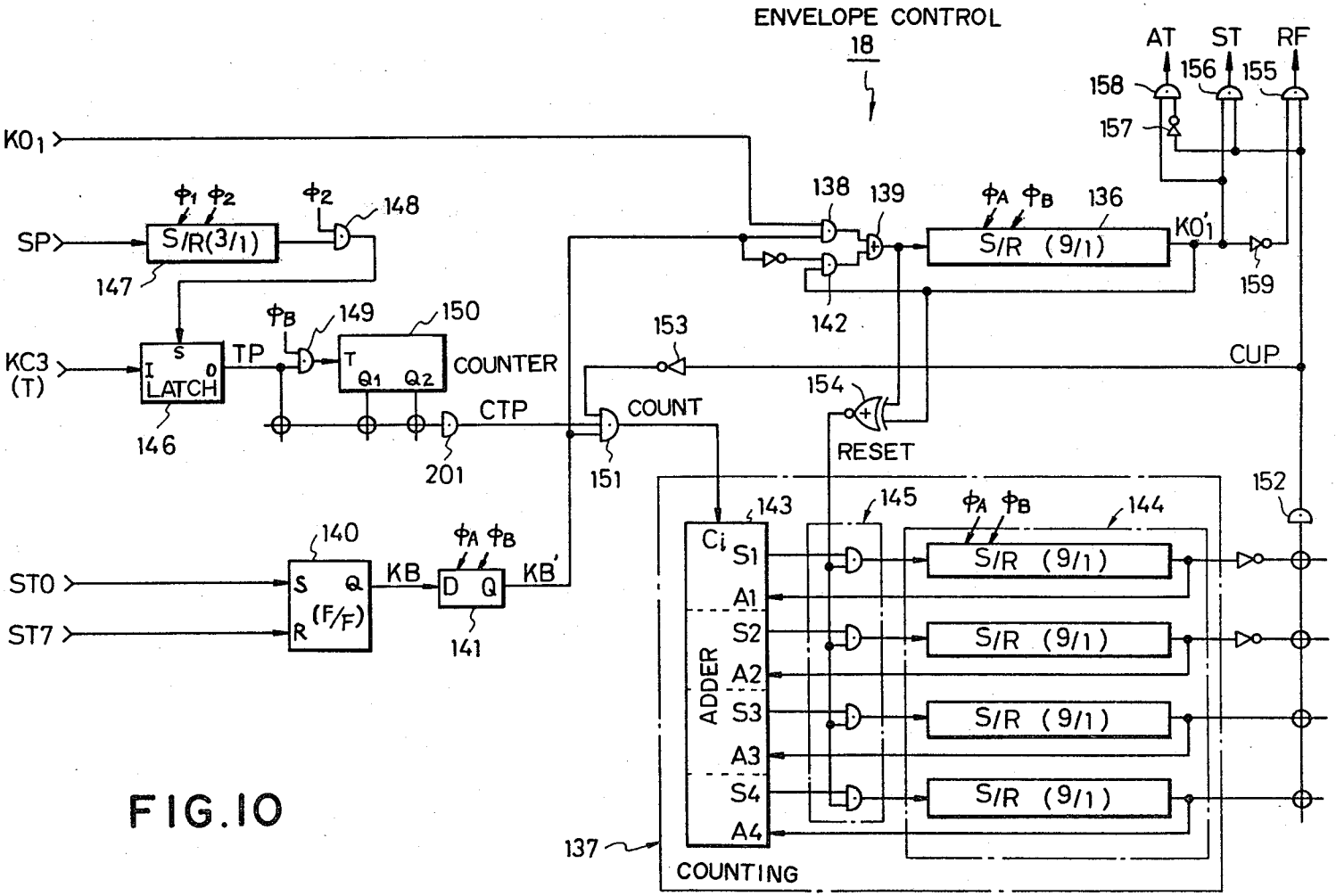
FIG. 10 is a circuit diagram showing details of an envelope control circuit shown in FIG. 1.

FIG. 10 shows the envelope control circuit 18 in detail. The envelope control circuit 18 comprises a key-on memory shift register 136 for storing the key-on signal KO1 is respect of each channel and a counter 137 for performing counting in a time-shared fashion with respect to each channel. The key-on memory shift register 136 is shift register of 9-stages capable of storing the key-on signals KO1 for seven channels of the first channel ch1 through the seventh channel ch7. The remaining two stages are always empty. The shift register 136 has nine stages because a circulating cycle of the shift register 136 is made to be divisor of the period of 54 microseconds in which the data KC1–KC4 is supplied to the tone generator 14. The shift register 136 is driven by the two-phase pulse $\phi A$, $\phi B$ with a period of 3 microseconds so that a period of one circulating cycle is $9 \times 3 = 27$ microseconds.

The key-on signal KO1 is supplied from the latch circuit 30 of the key code converter 16 to the AND gate 138 and thereafter is applied to the shift register 136 through an OR gate 139. As has already been explained, the key-on signal for the first channel ch1 is outputted from the latch circuit 30 in synchronism with the timing of the pulse ST1 (FIG. 6) and the key-on signals for the second through seventh channels are outputted in synchronism with the timings of the pulses ST2 through ST7. The AND gate 138 is provided for gating out only the key-on signal KO1 of a selected keyboard.

As described above, the pulses ST0 through ST7 are sequentially generated from the shift register 52 (FIG. 5) of the timing signal generator 17 every 3 microseconds during a time period from the time slot "3" to the time slot "26" and from the time slot "24" to the time slot "47". The AND gate 138 selects the key-on signal KO1 which is generated during the period from the pulse ST0 to the pulse ST7. More specifically, the pulse ST0 applied to the first stage of the shift register 52 is supplied to a set input S of a set-reset type flip-flop 140 and the pulse ST7 outputted from the seventh stage of the shift register 52 is supplied to a reset input R of the flip-flop 140. By this arrangement, an output KB of the flip-flop 140 is generated in a range of the pulse ST0 through ST7 is shown in FIG. 6 and a signal KB' obtained by delaying this output KB by 3 microseconds by a delay flip-flop 141 is generated in a range of the pulses ST1 through ST7 as shown in FIG. 6. The signal KB' is applied to the AND gate 138 to enable it only during the period of time when the pulses ST1 through ST7 are generated. This permits the key-on signal KO1 of a tone assigned to channels (ch1–ch7) of a keyboard selected by the keyboard selection switch 15 to pass through the OR gate 139. The output of a final stage of the shift register 136 is fed back to the first stage thereof through an AND gate 142 and the OR gate 139. The AND gate 142 receives at the other input thereof a signal obtained by inverting the signal KB' by an inverter. If, accordingly, the key-on signal KO1 is not newly loaded, the key-on signals KO1 for the respective channels are stored in the shift register 136 circulatingly and in a time-shared fashion.

The counter 137 consists of a 4-bit adder 143, a 9-stage/4-bit shift register 144 and a gate 145, and an output of a final stage of the shift register 144 being fed back to the adder 143. This shift register 144 is shifted by the pulses $\phi$A, $\phi$B. This circuit construction enables the counter 137 to perform the counting operation for each channel on a time-shared basis.

The data KC3 among the data KC1–KC4 which has been delayed by the delay flip-flop group 29 shown in FIG. 5 is supplied to the latch circuit 146 of the envelope control circuit 18. Since the timing pulse T is supplied as this data KC3 at the time slot "4" as shown in FIG. 2, the latch circuit 146 is so constructed that it will latch this timing pulse T. The reference pulse SP (FIG. 6) generated by the AND gate 35 of FIG. 5 is inputted to a shift register 147 of 3 stages where it is delayed by 3 microseconds in response to the master clock pulse $\phi$1, $\phi$2. The output of the shift register 147 is applied to an AND gate 148 and is selected by the pulse $\phi$2 at a first half of the time slot. An output of this AND gate 148 is applied to a strobe terminal S of a latch circuit 146. The reference pulse SP is generated at the time slot "1" (FIG. 6) so that the AND gate 148 produces an output "1" at the time slot "4". Accordingly, the contents of the data KC3 are loaded in the latch circuit 146 only at the timing "4" at which the timing pulse T is supplied as the data KC3. The latched contents of the latch circuit 146 are rewritten at each time slot "4", i.e., every 54 microseconds.

In the above described manner, a pulse TP in which the pulse width of the timing pulse T is rectified to 54 microseconds is produced. This pulse TP is applied to a 2-bit binary counter 150 through an AND gate 149. This counter 150 is provided for frequency dividing the pulse TP, i.e. the pulse T by four and its 2-bit output is applied to an AND gate 201. The AND gate 201 receives the pulse TP at the other input thereof. This is for rectifying the pulse width of the $\frac{1}{4}$ frequency divided output to the pulse width of the pulse, TP, i.e. 54 microseconds. Thus, a pulse CTP having a frequency which is $\frac{1}{4}$ of the frequency of the pulse T and a pulse width of 54 microseconds is outputted from the AND gate 201.

This pulse CTP is applied to the adder 143 through an AND gate 151. The AND gate 151 is a circuit for controlling supply of the counting pulse CTP to the counter 137. The signal KB' representing the time slot of the selected keyboard and signal obtained by inverting the output CUP of the AND gate 152 by an inverter 153 are applied to the AND gate 151.

The reset control in the counter 137 is performed by an exclusive NOR circuit 154. The exclusive NOR circuit 154 receives the output of the OR gate 139 and the output of the shift register 136. The output of the exclusive NOR circuit 154 is applied to the gate 154 to control resetting of the counter 137. The exclusive NOR circuit 154 produces a key-on pulse or a key-off pulse of a logical value "0" at instants of key-on and key-off thereby interrupting the gate 145 and resetting the counter 137. The input signal and the output signal of the shift register 136 are of the same channel and the output signal of the shift register 136 represents a state of an immediately preceding key-on signal KO1 of the same channel when the key-on signal KO1 is applied through the AND gate 138 so that an instant of key-on, key-off or other state can be discriminated by combination of states of the input and output signals of the shift register 136. Relations between the input and output of the exclusive NOR circuit 154 and states of the key are shown in Table 5.

TABLE 5

| State of key | input to exclusive NOR 154 Shift register 136 input | output | Output of exclusive NOR 154 |
|---|---|---|---|
| key-off | 0 | 0 | 1 |
| continued | | | |
| instant of key-on | 1 | 0 | 0 (key-on pulse) |
| key-on | 1 | 1 | 1 |
| continued | | | |
| instant of key-off | 0 | 1 | 0 (key-off pulse) |

Output of the two most significant bits of the counter 137 are applied to a 4-input type AND gate 152 and outputs of the two least significant bits are applied to the AND gate 152 after being inverted by inverters. The AND gate 152 is enabled when a counter in the counter 137 has reached "1100" and the output signal CUP of the AND gate 152 is turned to "1". An output of an inverter 153 thereupon is turned to "0" and an AND gate 151 is disabled to inhibit the count pulse TP. Conversely, the counter 137 is in an operable state when the signal CUP is "0".

The signal CUP is applied to AND gates 155 and 156 and to an AND gate 158 through an inverter 157. The AND gates 156 and 158 receive at the other inputs thereof the output $KO_1'$ of the key-on memory shift register 136. The AND gate 155 receives at the other input thereof a signal obtained by inverting the output $KO_1'$ of the shift register 136 by an inverter 159. The key-on memory signal $KO_1'$ is "1" at the key-on time and "0" at the key-off time. The output of the AND gate 155 is supplied as a release finish signal RF to the inverter 90 and the NOR gate 160 (FIG. 5) of the key code converter 16. To a latch circuit 161 (FIG. 9) of the envelope imparting circuit 132 in the tone waveform generator 22 for each channel is applied the output of the AND gate 158 as the attack time signal AT and the output of the AND gate 156 as the sustain time signal ST.

In the envelope control circuit 18, the key-on memory shift register 136 and the counter 137 are operating channel by channel in a time-shared fashion and, accordingly, the attack time signal AT and the sustain time signal ST are also generated channel by channel in a time-shared fashion. The latch circuit 161 (FIG. 9) of the envelope imparting circuit 132 latches only signals corresponding to its channel among the signals AT and ST supplied in a time-shared fashion. Accordingly, the pulse $\phi$A·ST1 corresponding to the timing of the first channel ch1 is supplied from the AND gate 53 (FIG. 5) as a strobe pulse of the latch circuit 161 for the first channel ch1. In the latch circuits 161 for the other channels ch2–ch7 also, the pulse $\phi A \cdot ST2$–$\phi A \cdot ST7$ corresponding to their channels are supplied from the AND gates 54–59 (FIG. 5).

The attack time signal AT′ latched in the latch circuit 161 is applied to an attack gate 162 and the sustain time signal ST′ to a sustain gate 163. The signals ST′ and AT′ outputted from the latch circuit 161 are applied to a NOR gate 200 to generate a release signal RT. This release signal RT is applied to a release gate 164. An attack resistor 165 is connected in series to the gate 162, a decay resistor 166 is connected in series to the gate 163 and a release resistor 167 is connected in series to the gate 164. A capacitor 168 is connected between a common junction of the respective resistors 165–167 and ground, the envelope shape supply line 134 leading from the common junction.

When the attack time signal AT′ is "1", the gate 162 is enabled and voltage corresponding to the peak level (e.g. −8 V) is applied to a capacitor 168 through the resistor 165. This charged voltage waveform is provided on the line 134 as the envelope shape of the attack portion. As the signal AT′ is turned to "0" and the signal ST′ to "1", the gate 162 is disabled whereas the gate 163 is enabled to supply voltage (e.g. −5 V) corresponding to the sustain level to the capacitor 168 through the resistor 166. The capacitor 168 thereby is discharged from the peak level to the sustain level and this discharge voltage waveform is provided on the line 134 as the envelope shape of the decay portion. Upon completion of discharging, the voltage of the capacitor 168 is maintained at a sustain level (e.g. −5 V) thereby providing the envelope shape of the sustain portion. As the signals AT′ and ST′ are turned to "0" by the key-off, the output of the NOR gate 163 is turned to "1" and the release signal RT is generated. The gate 164 only is enabled by this release signal RT and the capacitor 168 is discharged to the 0 level (i.e. ground voltage) through the resistor 167. The envelope shape of the release portion thereby is produced.

Description will now be made about generation of the signals AT, ST and RF with reference to FIG. 10 and the above listed Table 5.

While the key-off state is continued, the output of the exclusive NOR circuit 154 is "1" and the gate 145 is enabled but the counting operation of the counter 137 is stopped by the signal CUP which is "1". At the instant of key-on, the output of the exclusive NOR circuit 154 is turned to "0" that the gate 145 is disabled and the count of the channel in the counter 137 becomes "0000". This value "0000" is outputted after being delayed by nine shots of the two phase pulses $\phi A$, $\phi B$ (i.e. 9 bit time) in the shift register 144. Accordingly, the output of the AND gate 152 is turned to "0" at the timing of the same chnnel 9-bit time after turning of the output of the exclusive NOR circuit 154 to "0" and the output of the AND gate 151 thereupon is enabled. Simultaneously, both inputs of the exclusive NOR circuit 154 become "1" so that the gate 145 is enabled again.

The count pulse CTP is applied to the adder 143 through the enabled AND gate 151 and the counter 137 thereby starts counting. This counting operation is continued so long as the output signal CUP of the AND gate 152 is "0". When the signal CUP is "0", output of an inverter 157 is turned to "1" and this enables an AND gate 158. Since the key-on memory signal KO1′ also is turned to "1", the output of the AND gate 158 is turned to "1" and the attack time signal AT is generated at the timing of the specific channel. As described in the foregoing, this attack time signal AT is latched by the latch circuit 161 (FIG. 9) of the envelope imparting circuit 132 of the channel whereby the envelope shape of the attack portion is generated.

Upon generation of twelve count pulses CTP counting from the instant of the key-on, the count output of the counter 137 of the channel becomes "1100" and this enables the AND gate 152 to turn the signal CUP to "1". The counting operation of the counter 137 thereby is stopped. The AND gate 158 is disabled and the AND gate 156 is enabled by the signal CUP which is "1". If the key is kept depressed, the key-on memory signal KO1′ is "1" so that the sustain time signal ST is generated by the AND gate 156 whereas the attack time signal AT disappears. Accordingly, the attack time is a time equivalent to twelve shots of the pulse CTP. If, for example, the period of the timing pulse T is 3.456 ms, the period of the count pulse CTP is $3.456 \times 4 = 13.824$ ms and the attack time is $13.824 \times 12 = 165.888$ ms.

The sustain time signal ST is latched by a latch circuit 161 (FIG. 9) of the envelope imparting circuit 132 for the specific channel and the envelope shape from the decay portion to the sustain portion is generated in accordance with the latch signal ST′.

At the instant of key-off, the output of the exclusive NOR circuit 154 is turned to "0", once and the count of the counter 137 of the channel is reset. The output signal CUP of the AND gate 152 thereby is turned to "0" and the counter 137 is brought into an operable state. Turning of the signal CUP to "0" causes the AND gate 156 to be disabled and the sustain time signal ST to be extinguished. The key-on memory signal KO1′ is turned to "0" by the key-off and the AND gate 158 thereby is disabled. Accordingly, the outputs AT′ and ST′ of the latch circuit 161 (FIG. 9) are both turned to "0" and the release signal RT is provided by the NOR gate 200. The envelope shape of the release portion thereby is generated from the envelope imparting circuit 132 with a result that the tone signal of the channel gradually attenuates and disappears.

The counter 137 resumes counting from "0000" at the instant of key-off. As twelve shots of the count pulse CTP have been generated and the count has reached "1100", the output CUP of the AND gate 152 is turned to "1" thereby causing the counting to stop. On the other hand, the key-on memory signal KO1′ is turned to "0" by the key-off so that the output of the inverter 159 is turned to "1". Accordingly, if the signal CUP becomes "1" during the key-off time, the output of the AND gate 155 is turned to "1" and the release finish signal RF thereby is generated. If the period of the timing pulse T is set at 3.457 ms as was previously described, time from the instant of key-off to generation of the release finish signal RF is 165.888 ms. In other words, upon lapse of 165.888 ms (hereinafter referred to as "release time") after key-off, the release finish signal RF is generated. This release finish signal RF is continuously generated (in a time shared fashion in correspondence to the timing of the specific channel) until a tone of a newly depressed key is assigned to the channel (i.e., until a corresponding channel of the counter 137 is reset by the output "0" of the exclusive NOR gate 154 which is generated at the instant of key-on).

The release finish signal RF is supplied to the inverter 90 and the NOR gate 160 of the key code converter 16 (FIG. 5). Accordingly, when the release finish signal RF is generated, the output of the inverter 90 is turned to "0" thereby disabling the AND gate 89 whereas the output of the NOR gate 160 is turned to "0" thereby disabling the gate 65. If the tone assigned to the channel is for the lowest note C2, generation of the signal CL is inhibited by disabling of the AND gate 89. Accordingly, in the note selector 20 of the channel shown in FIG. 7, the superposed frequency data (P, Q2–Q9) on the line 24'-1 which has been selected in response to the signal CL is inhibited and the data signal is no longer supplied to the octave selector 21. If the tone assigned to the channel is tones other than the lowest note C2, generation of the note signal n1–n7 is inhibited by disabling of the gate 65 (FIG. 5). Accordingly, in the note selector 20 of the channel shown in FIG. 7, the octave multiplexed data (P, Q1–Q8) on the lines 24-1 through 24-12 which has been selected in response to the note signal n1–n7 is inhibited and the data is not longer supplied to the octave selector 21. In the above described manner, if the release finish signal RF is generated in a certain channel, the outputs A1–A6 of the latch circuit 115 (FIG. 7) of the octave selector 21 of that channel are all turned to "0" whereby generation of the tone signals (sawtooth wave and rectangular wave) in the tone signal generator 22 (FIG. 9) of that channel is prevented. Alternatively stated, not only the envelope shape for controlling the amplitude of the musical tone is extinguished by finishing of release but also the address itself of the waveform memory 129 (or gating control of the gate 131 itself) is stopped. Consequently, generation of noise after key-off is effectively prevented.

Figure 11:
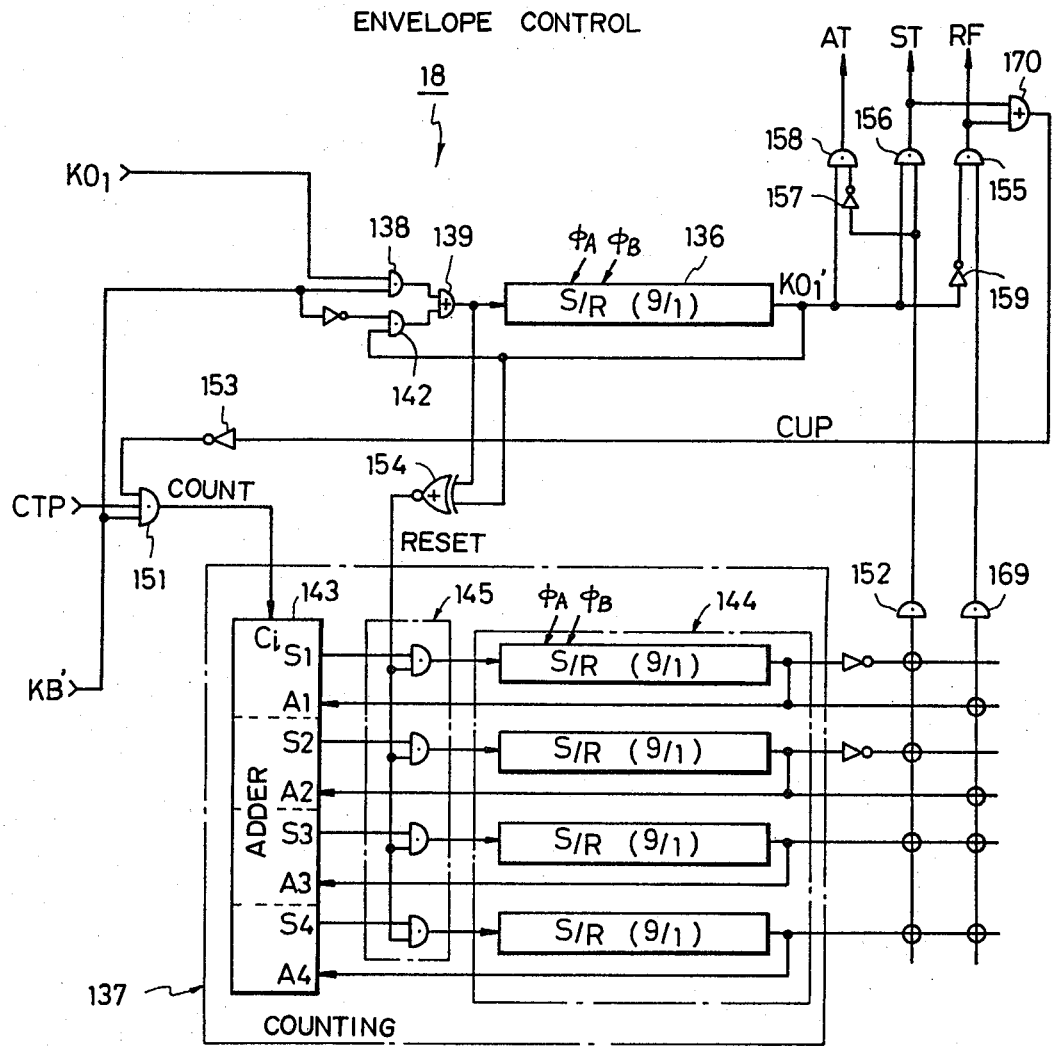
FIG. 11 is a circuit diagram showing a modified example of the envelope control circit.

A modified embodiment of the present invention will now be described. In the above described embodiment, operation of the counter 137 of the envelope control circuit 18 is stopped when the count has reached "1100" so that the release time is of the same length as the attack time. The invention is not limited to this but any desired length may be set for the release time. FIG. 11 shows one modified example. In FIG. 11, the same reference characters as those used in FIG. 10 designate circuits of the same function and illustration of circuits for generating the count pulse CTP and the signal KB' is omitted.

Referring to FIG. 11, an AND gate 152 for detecting reaching of the count of a counter 137 to "1100" is used for setting the attack time. For setting the release time, an AND gate 169 is provided. The AND gate 169 receives a 4-bit output of the counter 137 and produces an output "1" when the count has reached "1111". This output of the AND gate 169 is applied to an AND gate 155 for generating a release finish signal RF. The output of the AND gate 152 is applied only to an AND gate 156 for generating a sustain time signal ST and an inverter 157 for generating an attack time signal AT and is not applied to an AND gate 155. A signal CUP for controlling the counting operation is generated from an OR gate 170. To this OR gate 170 are applied to the outputs of the AND gates 155 and 156. Owing to the above described construction, the circuit shown in FIG. 11 produces a release finish signal RF when fifteen shots of the count pulse CTP have been generated (i.e. when the count value has reached "1111"). Accordingly, the release time is about 207 ms, which is longer than the attack time.

Figure 12:
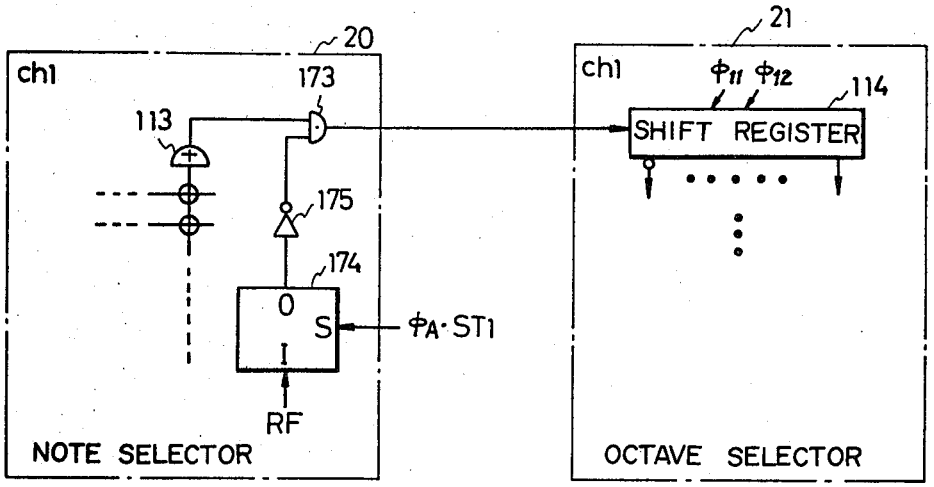
FIG. 12 is a circuit diagram showing a modified example of the note selector shown in FIG. 7.

In the above described embodiment, the generation of the note signals n1–n7 and CL is prevented by supplying the release finish signal RF to the key code converter 16. The invention, however, is not limited to this but any other arrangement utilizing the release finish signal RF for preventing generation of the tone signals falls within the scope of the invention. For example, the release finish signal RF may be supplied to the note selector 20 or the octave selector 21 of each of the channels ch1–ch7 as shown by a broken line 171 or 172 so that supply of the data from the note selector 20 to the octave selector 21 or supply of the signal A1–A6 from the octave selector 21 to the tone waveform generator 22 may be prevented. In the case where the release signal RF is supplied to the note selector 20, the circuit construction of the note selector 20 shown in FIG. 7 is modified to the one shown in FIG. 12. In FIG. 12, only the OR gate 113 and the shift register 114 which are necessary for explanation are illustrated and other circuits in the note selector 20 and the other selector 21 are omitted. An AND gate 173 is inserted between the OR gate of the note selector 20 and the shift register 114 of the octave selector 21. This AND gate 173 is controlled by an output of a latch circuit 174 which latches the release finish signal RF which output is applied to the AND gate 173 through an inverter 175. One of the pulses $\phi$A·ST1–$\phi$·ST7 ($\phi$A·ST1 in the case of the first channel ch1) corresponding to the specific channel is supplied from one of the AND gates 53–59 (FIG. 5) to a strobe terminal S of the latch circuit 174. Since the release finish signals RF from the envelope control circuit 18 (FIG. 10 or 11) for the respective channels ch1–ch7 are generated in a time-shared fashion, arrangements are made so that the note selector 20 of each of the channels ch1–ch7 latches the release finish signal RF corresponding to its channel by the latch circuit 174. Upon generation of the release finish signal RF, the output of the latch circuit 174 is turned to "1" and the output of the inverter 175 is turned to "0" thereby disabling the AND gate 173. Supply of the superposed frequency data from the note selector 20 to the octave selector 21 thereby is stopped so that generation of the tone signal is prevented.

Figure 13:
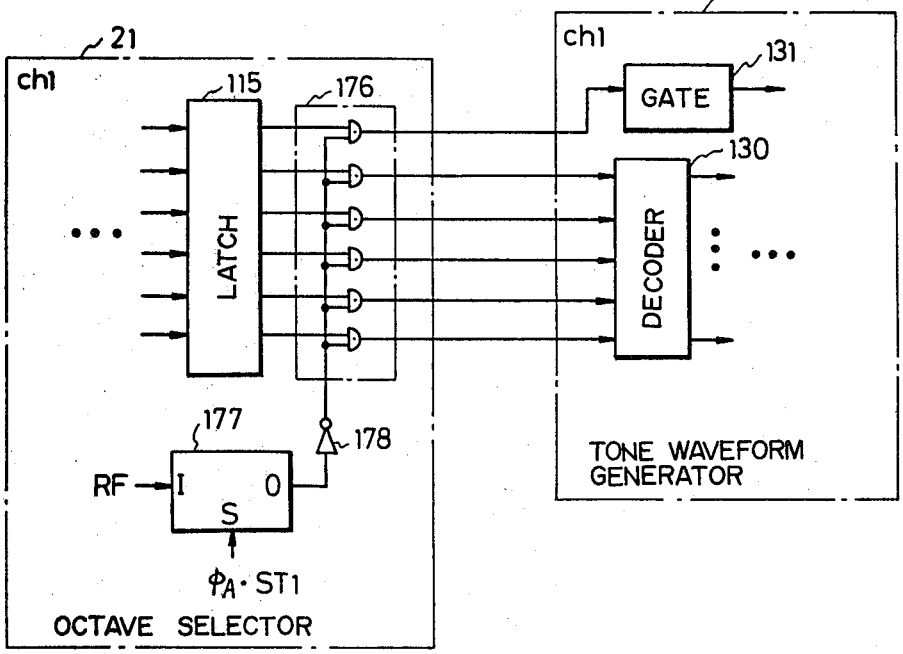
FIG. 13 is a circuit diagram showing a modified example of the octave selector.

In the case where the release finish signal RF is supplied to the octave selector 21, the octave selector 21 shown in FIG. 7 is modified to the construction shown in FIG. 13. In FIG. 13, only circuits 115, 130 and 131 which are necessary for explanation are illustrated and other circuits in the octave selector 21 and the tone waveform generator 22 are omitted. A gate 176 is inserted between the latch circuit 115 of the octave selector 21 and the decoder 130 and the gate 131 of the tone waveform generator 22. This gate 176 is controlled by an output of the latch circuit 177 which latches the release finish signal RF which output is applied to the gate 176 through an inverter 178. The latch circuit 177 is controlled, like the above described latch circuit 174, by one of the pulses $\phi$A·ST1=$\phi$·ST7 corresponding to its channel. When the release finish signal RF of a certain channel is generated, the output of the latch circuit 177 in the octave selector 21 corresponding to the channel is turned to "1" and the gate 176 is interrupted through inverter 178. This interrupts the supply of the address signal A1–A5 and the rectangular wave tone source signal A6 to the tone waveform generator 22 whereby generation of the tone signal is prevented. In the circuit construction shown in FIG. 12 or FIG. 13, the release finish signal RF need not be supplied to the key code converter 16. The object of the invention may be achieved by means other than those shown in FIG. 12 or FIG. 13. For example, an arrangement may be made so that the output of the latch circuit 98 or the AND gates 99-111 of the note selector 20 is inhibited by the output of the latch circuit 174 shown in FIG. 12 or the latch circuit 177 shown in FIG. 13. Alternatively, the input side of the latch circuit 115 of the octave selector 21 shown in FIG. 7 may be interrupted.

According to the present invention, generation of noise after release of the key can be completely prevented. Further, since the counter for the envelope control is commonly used as the counter for counting a predetermined number of count pulses for setting timing of preventing generation of the tone signal, the circuit construction is remarkably simplified. Further, the arrangement of resetting the counter both at the beginning of the key-on and at the beginning of the key-off reduces the bit number of the counter and therefore is economical as compared with the design in which the counter is continuously used without resetting at the beginning of the key-off.

What is claimed is:

1. An electronic musical instrument comprising:

keys for playing notes of the instrument:

a key detection circuit for producing per each of depressed ones of said keys a key identifying signal which represents a name of the key and a key-on signal which represents an on-off state of the key;

a tone generator circuit for generating musical tone signals each with a respective amplitude envelope and respectively corresponding to the key identifying signals;

a key on-off memory circuit for receiving said key-on signal and storing the on-off state of said key;

a key-on pulse generation circuit for generating a key-on pulse at the beginning of the key depression;

a counter which starts counting upon receipt of said key-on pulse;

a control circuit for generating a control signal which controls the start of said amplitude envelope in response to a count value of said counter and on condition that said key on-off memory circuit stores an on-state of the key;

a key-off pulse generation circuit for generating a key-off pulse at the beginning of a release of the depressed key, said counter being reset and its counting started again by this key-off pulse;

a release finish signal generated circuit for generating a release finish signal when the count valve of said counter has reached a preset value on condition that said key-on memory circuit stores an off-state of the key; and a prevention circuit for preventing, responsive to said release finish signal, generation of said musical tone signal corresponding to the key which has caused the key-off pulse to be generated.

2. An electronic musical instrument as defined in claim 1 wherein said tone generator circuit includes a plurality of tone production channels each for generating a musical tone signal as assigned with one of said key identifying signals and each including separately an envelope imparting circuit constituted by a charge-discharge network which provides said amplitude envelope, and which instrument further comprises a channel assignment circuit for assigning said key identifying signals and said key-on signals respectively in a pair to available ones of said tone production channels.

3. An electronic musical instrument as defined in claim 2 wherein said key on-off memory circuit comprises a shift register having stages in a number equal to the number of said tone production channels, signals representative of on-off states of keys assigned to said channels being applied to said shift register in a time-shared fashion and circulatingly stored in the respective stages of said shift register, and wherein said counter comprises an adder to which predetermined count pulses are applied, a shift register storing outputs of said adder in a time-shared fashion with respect to each of said channels and feeding back to stored contents to said adder for adding to said count pulse and a gate for resetting a count value, said counter preforming counting in a time-shared fashion with respect to each of said channels and said release finish signal being generated from said release finish signal generation circuit in a time-shared fashion with respect to each of said channels.

4. An electronic musical instrument as defined in claim 3 wherein each of said key-on pulse generation circuit and said key-off pulse generation circuit consists of a single exclusive OR logical circuit, input and output signals of said shift register included in said key on-off memory circuit are applied to said exclusive OR logical circuit and said gate of said counter is controlled by outputs of said exclusive OR logical circuit, a count value corresponding to one of said channels to which a key has been assigned being rest by outputs of said exclusive OR logical circuit generated respectively at the beginning of depression of said key and at the beginning of release of said key.

5. In a keyboard electronic musical instrument in which depressed keys are identified by key codes, said instrument having a tone production assignment circuit and a multichannel tone generator generating plural tones respectively corresponding to key codes assigned by said tone production assignment circuit to ones of said channels, and in which said tone production assignment circuit continues to supply to said tone generator each assigned key code even after release of the corresponding key, until such key code is replaced by the assignment to the same channel of a key code associated with a newly depressed key, the improvement comprising:

envelope control means, cooperating with said tone generator, for controlling the amplitude envelope of each tone generated by said tone generator in response to depression and release of the key associated with the key code assigned to that channel, and for producing a release finish signal a set duration of time after release of each such key, and tone production inhibit means, cooperating with said envelope control means and said tone generator, for inhibiting, in response to occurrence of said release finish signal, tone production by said tone generator of the tone in the channel for which the associated key has been released, despite continued supply to said tone generator of the key code for that released key by said tone production assignment circuit.

6. In a keyboard polyphonic musical instrument having a tone generator and an envelope imparting circuit that produces an envelope signal which establishes the amplitude envelope of the generated tone, said envelope having at least attack and release portions, an envelope control cooperating with said envelope imparting circuit and comprising:

a counter, counting of said counter being first initiated in response to key depression, the count of said counter then timing the attack portion of the envelope, and key-off reset means for resetting and again initiating counting of said counter in response to key release, the count now timing the release portion of said envelope, whereby both the attack and release portions of said envelope are timed by successive counts of said counter from a common initial condition.

7. An electronic musical instrument according to claim 6 wherein said tone generator has plural channels for generating plural tones respectively designated by key codes assigned by a channel assigner, together with:

tone production inhibit means, cooperating with said counter, for inhibiting tone generation in a certain channel despite continued supply to said tone generator of the key code assigned to that channel by said channel assigner after release of the corresponding key, said inhibiting occurring in response to said counter reaching a certain count value after said resetting in response to key release.

8. For use in a polyphonic keyboard electronic musical instrument of the type in which key codes corresponding to depressed keys are assigned to respective tone production channels by a tone production assignment circuit, the key codes so assigned being thereafter continuously supplied to a tone generator until the key code in a particular channel is replaced by the assignment to the same channel of the key code of a newly depressed key, each channel having an envelope generator for imparting to the musical tone produced in the corresponding channel an amplitude envelope having an attack portion, a sustain portion and a release portion, the improvement comprising:

an envelope control means, common to all channels, for providing contron signals to the envelope generators in all channels in accordance with the depressed or released state of the key corresponding to the key code assigned to that channel, said envelope control means including:

a counter for each channel, means for incrementing each counter at a selected rate in response to depression of the key for the corresponding channel, means providing control signals to switch from attack portion to sustain portion envelope production in response to the envelope counter for each channel reaching a certain value, and reset means responsive to release of the key in each channel, for resetting said counter to its initial value and thereafter incrementing said counter at a selected rate, release portion production being enabled while said counter then is counting, a release finish signal being generated when said counter reaches a preset value, and inhibit circuitry for inhibiting tone generation for the corresponding channel in response to occurrence of the release finish signal despite continued supply of said key code.

9. For use in a keyboard electronic musical instrument, an envelope generator comprising:

first means for generating an attack envelope in response to a first control signal, second means for generating a sustain envelope in response to a second control signal, third means for generating a release envelope in response to the absence of both said first and second control signals, envelope control means, including a counter operative upon key depression to count to a fixed value, for producing said first control signal during said count and for producing said second control signal after said fixed value is reached, means, responsive to key release, for resetting said counter and initiating continued counting by said counter from the value to which it was reset, both said first and second control signals being inhibited during said continued counting so that said third means generates said release envelope, and tone prohibition means, responsive to a signal generated when said continued counting reaches a certain value, for inhibiting further tone generation by said instrument.

* * * * *